US007169526B2

(12) United States Patent
Ishikawa et al.

(10) Patent No.: US 7,169,526 B2
(45) Date of Patent: Jan. 30, 2007

(54) TONER FOR THE DEVELOPMENT OF ELECTROSTATIC IMAGE AND THE PRODUCTION PROCESS THEREOF

(75) Inventors: Tomoko Ishikawa, Kanagawa (JP); Yuqing Xu, Kanagawa (JP); Katsuo Koizumi, Kanagawa (JP); Noriaki Takahashi, Tokyo (JP); Osamu Ando, Kanagawa (JP)

(73) Assignee: Mitsubishi Chemical Corporation, Tokyo (JP)

( * ) Notice: Subject to any disclaimer, the term of this patent is extended or adjusted under 35 U.S.C. 154(b) by 0 days.

(21) Appl. No.: 09/737,579

(22) Filed: Dec. 18, 2000

(65) Prior Publication Data

US 2001/0033982 A1 Oct. 25, 2001

(30) Foreign Application Priority Data

Dec. 16, 1999 (JP) ..... 11-356833
Jun. 19, 2000 (JP) ..... 2000-182606

(51) Int. Cl.
*G03G 9/08* (2006.01)

(52) U.S. Cl. ..... 430/110.1; 430/110.2; 430/137.11; 430/137.14

(58) Field of Classification Search ..... 430/110.1, 430/110.2, 110.3, 110.4, 108.1, 137.14, 108.4, 430/108.8, 109.3, 137.11, 108.23
See application file for complete search history.

(56) References Cited

U.S. PATENT DOCUMENTS 4,839,255 A * 6/1989 Hyosu et al. ..... 430/137.18
5,213,932 A * 5/1993 Shimazaki et al. .... 430/108.23
5,547,802 A * 8/1996 Kawase et al. ..... 430/108.24
5,849,456 A 12/1998 Matsumura et al. ..... 430/126
5,935,751 A * 8/1999 Matsuoka et al. ..... 430/108.8
5,965,316 A 10/1999 Kmiecik-Lawrynowicz et al.
6,030,739 A 2/2000 Ishikawa et al.
6,077,635 A * 6/2000 Okado et al. ..... 430/110.3
6,177,223 B1 * 1/2001 Hashimoto et al. ..... 430/110.1
6,190,819 B1 2/2001 Takahashi et al.
6,555,281 B1 * 4/2003 Nozawa et al. ..... 430/108.6
6,610,453 B2 * 8/2003 Akai et al. ..... 430/108.3
6,656,653 B2 * 12/2003 Mitsuhashi et al. .... 430/108.23
2002/0028402 A1 * 3/2002 Matsuoka et al. ..... 430/110.3

FOREIGN PATENT DOCUMENTS

JP 59-165069 * 9/1984 ..... 430/108.23
JP 10-26842 * 1/1998
JP 10-301332 11/1998

OTHER PUBLICATIONS

U.S. Patent & Trademark Office English-Language Translation of JP 59-165069 (pub Sep. 1984).*
U.S. Appl. No. 09/829,930, filed Apr. 11, 2001.
U.S. Appl. No. 09/737,579, filed Dec. 18, 2000.

* cited by examiner

*Primary Examiner*—Janis L. Dote
(74) *Attorney, Agent, or Firm*—Oblon, Spivak, McClelland, Maier & Neustadt, P.C.

(57) ABSTRACT

A toner for the development of an electrostatic image is provided wherein at least one layer of a particulate resin is coated onto a substantial portion of the surface of an agglomerate of particles made from at least primary polymer particles and primary colorant particles, wherein at least one of the primary polymer particles and the particulate resin contains a wax, and the particulate resin of the outermost layer is substantially free of wax and a process for producing the toner.

5 Claims, 6 Drawing Sheets

TONER FOR THE DEVELOPMENT OF ELECTROSTATIC IMAGE AND THE PRODUCTION PROCESS THEREOF

FIELD OF THE INVENTION

The present invention relates to a toner for the development of an electrostatic image, particularly for use in electrophotographic process copying machines and printers. More particularly, the present invention relates to a toner prepared by emulsion polymerization agglomeration method or a toner wherein a particulate wax is relatively uniformly dispersed therein.

BACKGROUND OF THE INVENTION

A conventional toner for the development of an electrostatic image which has previously been widely used in electrophotography has been prepared by a process which comprises melt-kneading a mixture of a binder resin such as of a syrene-acrylate copolymer, or polyester, a coloring agent such as carbon black and a pigment, a charge controller and/or a magnetic material through an extruder, grinding the material obtained, and then classifying the resulting powder. However, the conventional toner obtained by such a melt-kneading/grinding process has the disadvantage that the controllability of the particle diameter of the toner is limited, making it difficult to prepare a toner substantially having an average particle diameter of not more than 10 μm, particularly not more than 8 μm in a good yield. Thus, the conventional toner cannot be considered good enough to provide the high resolution that will be required in the future electrophotography.

In order to achieve oil-less low temperature fixability, an approach involving the blend of a low softening wax in a toner during kneading has been proposed. In the kneading/crushing process, however, the amount of such a wax to be blended is limited to about 5 w/w %. Thus, toners having a sufficient low temperature fixability cannot be obtained.

In an attempt to overcome difficulty in controlling the particle diameter and hence realize high resolution, JP-A-63-186253 (The term "JP-A" as used herein means an "unexamined published Japanese patent application") proposes a process for the preparation of a toner involving emulsion polymerization/agglomeration process. However, this process is limited in the amount of wax that can be effectively introduced into the agglomeration step. Thus, this process leaves something to be desired in the improvement in oil-less low temperature fixability.

Specifically, the present inventors have conducted investigations by increasing the addition amount of wax on the basis of teach of the above-described patent. As the result, it was found that with increasing the addition amount of the wax, the resulting toner undesirably had two peaks in a particle diameter distribution or finely divided powder having a particle diameter of 1 μm or less remained, which required a classification step after the agglomeration step.

In U.S. Pat. No. 5,849,546 and JP-A-10-301322, a so-called capsulated toner is disclosed that is produced by agglomerating primary polymer particles obtained by emulsion polymerization, then fixing a particulate resin on the surface of the resulting agglomerated particles. In this publication, low temperature fixability and high resolution are attempted to be achieved. However, neither primary polymer particles comprising wax encapsulated therein nor particulate resin comprising wax encapsulated therein are used and, therefore, sufficient performance is difficult to achieve.

In U.S. Pat. No. 5,965,316 a toner is disclosed wherein a particulate resin obtained by emulsion polymerization using wax as seed is coated over an agglomerate of particles. In this toner, however, the wax is present in a large amount in the outermost layer thereof and, therefore, the wax leaks out prior to fixing. This can pollute the apparatus with wax residue and is very detrimental to the process.

SUMMARY OF THE INVENTION

Accordingly, one object of the present invention is to provide a toner having high resolution, and a sufficient oil-less low temperature fixability and offset resistance, especially broad fixing temperature width, excellent charged amount, OHP-transparency and blocking resistance, which overcomes the above identified disadvantages.

A further object of the present invention is to provide a method for preparing a toner having the above-noted properties.

These and other objects of the present invention have been satisfied by the discovery of a toner comprising an aggregate prepared from a mixture comprising primary polymer particles, obtained by emulsion polymerization using a wax emulsion as seed, and primary colarant particles, having thereon a coating of at least one layer of a particulate resin, such that the outermost layer of particulate resin is substantially free of wax.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DETAILED DESCRIPTION OF THE INVENTION

Figure 1:
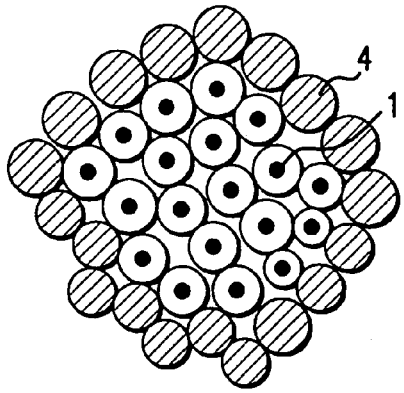
FIG. 1 is a schematic representation of a toner particle wherein particulate resin substantially free of wax is covered over an agglomerate of primary polymer particles having wax encapsulated therein.
Figure 2:
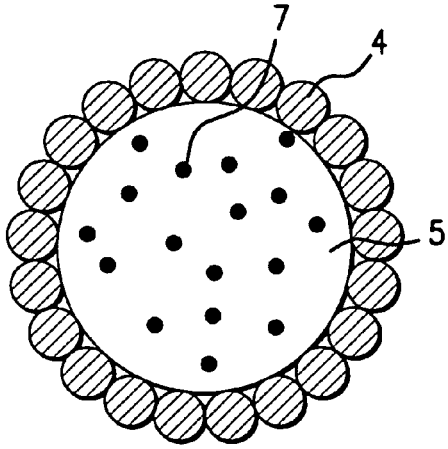
FIG. 2 is a schematic representation of a toner particle wherein an agglomerate of primary polymer particles having wax encapsulated therein are fused together, and wherein the agglomerate has a coating of particulate resin substantially free of wax.

The present invention relates to a toner, particularly for the development of an electrostatic image, comprising an agglomerate of a mixture comprising primary polymer particles, wherein said agglomerate has coated thereon at least one layer of a particulate resin, wherein at least one of the primary polymer particles and the particulate resin contains a wax, and the particulate resin of the outermost layer is substantially free of wax.

Another embodiment of the present invention relates to a toner comprising a binder resin and a particulate wax, wherein the toner has a volume-average particle diameter of from 3 to 12 μm, a half value width of a number-average particle diameter of particulate wax contained therein, when the cross section of the toner is observed, of 0.06 μm or less, and wherein the distribution of particulate wax having an average particle diameter of 0.01 μm or more throughout the toner particle satisfies the following equation:

$$(A/B)/(C/D) \leqq 0.1$$

wherein A is total area of wax particles contained in the outermost layer to a depth of 0.1 μm;

B is total area of the outermost layer;

C is total area of wax particles contained in the remainder of the toner particle (at a depth of greater than 0.1 μm from the surface of the particle); and D is total area of said remainder of toner particle, wherein all areas are measured as observed in a cross section of said toner particle through a center point of said toner particle.

A further embodiment of the present invention relates to a process for producing a toner comprising agglomerating at least primary polymer particles and primary colorant particles to form an agglomerate of particles, coating at least a substantial surface portion of said agglomerate with at least one layer of a particulate resin, wherein the primary polymer particles are preferably obtained by seed emulsion polymerization of a monomer mixture in the presence of particulate wax, and an outermost layer of the particulate resin is substantially free of wax.

The toner according to the present invention comprises wax, primary polymer particles, primary colorant particles and particulate resin as the constituent components, and, if desired, further comprises a charge control agent and/or other additives. The toner of the present invention is preferably produced by an emulsion polymerization agglomeration method. According to the emulsion polymerization agglomeration method, the toner is produced by co-agglomerating at least primary polymer particles obtained by emulsion polymerization, and primary colorant particles and, depending upon necessity, primary charge control agent particles to form an agglomerate of particles, followed by coating a substantial portion of the surface of the agglomerate with a particulate resin.

Further, in the toner of the present invention, primary polymer particles and/or particulate resin comprise(s) wax therein and the particulate resin of the outermost layer of the toner is substantially free of wax so that the wax is not exposed on the surface.

Wax

The wax used in the present invention, can be any conventional wax. A wax having a melting point of 30 to 100° C. is preferred to improve fixability of the toner. Examples of such waxes include olefinic waxes such as low molecular weight polyethylene, low molecular weight polypropylene and polyethylene copolymer; paraffin waxes; ester-based waxes having a long-chain aliphatic group such as behenyl behenate, montanic acid ester and stearyl stearate; vegetable waxes such as hydrogenated castor oil and carnauba wax; ketones having a long-chain alkyl group such as distearyl ketone; silicones having an alkyl group; higher aliphatic acids such as stearic acid; long-chain aliphatic alcohols such as eicosanol; carboxylic acid esters of polyhydric alcohols such as glycerol and pentaerythritol, and long chain aliphatic acids or partial esters thereof; and higher aliphatic acid amides such as oleic acid amide and stearic acid amide; and low molecular polyesters.

Among these waxes, those having a melting point of not less than 30° C. are preferred, with a melting point of not less than 40° C. being more preferred, and a melting point of not less than 50° C. being most preferred to improve the fixability of the toner. Further, it is preferred that the wax have a melting point of not higher than 90° C., more preferably not higher than 80° C. If the melting point of wax is too low, the wax may be exposed on the surface of the toner after fixing, which is liable to produce a stickyfeel. On the contrary, if the melting point is too high, the toner can be deteriorated in fixability at a low temperature.

As the wax compound, an ester-based wax obtained from an aliphatic carboxylic acid and a monovalent or polyvalent alcohol is preferably used. Among ester-based waxes, those having 20 to 100 carbon atoms are more preferable and those having 30 to 60 carbon atoms are particularly preferable.

Among esters of a monovalent alcohol and an aliphatic carboxylic acid, behenyl behenate and stearyl stearate are most preferred. Among esters of a polyvalent alcohol and an aliphatic carboxylic acid, stearic acid ester of pentaerythritol and the partial ester thereof, montanic acid ester of glycerol and the partial ester thereof are most preferred.

The above-described waxes can be used alone or in any mixture thereof. Further depending upon the fixing temperature of the toner, the melting point of a wax compound can be optionally selected. In the context of the present invention the term "wax" can refer to a single wax compound or a mixture of wax compounds.

For the purpose of enhancing fixability, a mixture of two or more, preferably three or more wax compounds is particularly effective. In particular, it is preferable that three or more wax compounds are used together and that formulation amounts of respective compounds preferably do not exceed 60 w/w %, more preferably 45 w/w % and most preferably 40 w/w %, of the entire wax.

When using mixtures of wax compounds, it is preferable that at least one of the waxes is the above-described carboxylic acid ester of a monovalent or polyvalent alcohol. The wax compound present in the highest amount is more preferably an alkanoic acid ester of a monovalent or a polyvalent alcohol, most preferably an alkyl ester of an alkanoic acid. In the case where the most abundant wax compound is an alkyl ester of an alkanoic acid, the second most abundant wax compound is preferably a different alkyl ester of an alkanoic acid or alkanoic acid ester of a polyvalent alcohol.

Mixtures of wax compounds more preferably contain 4 or more wax compounds, most preferably 5 or more wax compounds. The upper limit of wax compounds in the mixture is not particularly limited. However, in view of production, it is preferably 50 different wax compounds or less.

If at least three kinds of wax compounds are present, the sum of the two most abundant wax compounds is preferably 88% or less, more preferably 85% or less, and particularly preferably 80% or less.

The wax compound most abundant in the mixture preferably has a melting point of 40° C. or more, more preferably 50° C. or more. Further, the wax compound most abundant in the mixture preferably has a melting point of 90° C. or less, more preferably 80° C. or less. Further, particularly preferably, the two most abundant wax compounds each have a melting point of 40° C. to 90° C.

As will be described later, the toner of the present invention has a structure such that a particulate wax is relatively uniformly distributed in the toner. It can be estimated that wax having a relatively wide temperature width from the start of melting to the completion of melting, i.e., wax in the form of a mixture and having a low purity, can be readily discharged from the toner during fixing, even if the fixing temperature is varied. Thus, such wax can provide the desired fixability.

Emulsifier

Particulate wax to be used in the present invention is obtained by emulsifying the above-described wax in the presence of at least one emulsifier selected from known cationic surfactant, anionic surfactant or nonionic surfactant. Two or more kinds of these surfactants can be used together.

The wax used in the present invention has a melting point of 30 to 100° C. Thus, since the wax has a melting point less than the boiling point of water, where the dispersion of wax particles is prepared by emulsifying the wax, the wax is preferably dispersed and emulsified in a molten state (i.e. by heating a mixture of wax, water and emulsifier to the temperature of the melting point of the wax or more). Specific examples of suitable cationic surfactants include dodecyl ammonium chloride, dodecyl ammonium bromide, dodecyl trimethyl ammonium bromide, dodecyl pyridinium chloride, dodecyl pyridinium bromide, and hexadecyl trimethyl ammonium bromide.

Specific examples of suitable anionic surfactants include aliphatic soap such as sodium stearate and sodium dodecanate, sodium dodecyl sulfate, sodium dodecylbenzenesulfonate, and sodium laurylsulfate.

Specific examples of suitable nonionic surfactants include polyoxyethylenedodecyl ether, polyoxyethylenehexadecyl ether, polyoxyethylenenonylphenyl ether, polyoxyethylenelauryl ether, polyoxyethylene sorbitan monoleate ether, and monodecanoyl succrose.

Among these surfactants, an alkali metal salt of a straight chain alkylbenzene sulfonic acid is preferable.he volume-average particle diameter of the particulate wax is preferably from 0.01 μm to 3 μm, more preferably from 0.1 μm to 2 μm, and particularly from 0.3 to 1.5 μm. For the measurement of average particle diameter, LA-500 produced by Horiba Co., Ltd. may be used. If the average particle diameter of the particulate wax exceeds 3 μm, the polymer particles obtained by seed polymerization can be too large to produce a high resolution toner. On the contrary, if the average particle diameter of the emulsion falls below 0.01 μm, it may be difficult to prepare the dispersion thereof.

Primary Polymer Particles

One feature of the present invention resides in that primary polymer particles and/or the particulate resin, other than that of the outermost layer, contain a wax encapsulated therein. In the case where the primary polymer particles contain a wax encapsulated therein, the production method thereof is not particularly limited. Preferably, however, primary polymer particles are obtained by seed emulsion polymerization of a monomer mixture using a particulate wax as seed.

Primary polymer particles obtained by emulsion polymerization using a particulate wax as seed (preferred embodiment of the present invention) will be explained below.

In order to effect seed emulsion polymerization, a monomer having a Brönsted acidic group (hereinafter, referred to as simply an acidic group) or a monomer having a Brönsted basic group (hereinafter, referred to as simply a basic group) and a monomer having neither a Brönsted acidic group nor a Brönsted basic group (hereinafter, also referred to as other monomer) are successively added to cause polymerization in the emulsion containing particulate wax. During this procedure, these monomers may be added separately or concurrently in any combination. Alternatively, a plurality of monomers may be previously mixed before being added. Further, the composition of monomers to be added may be changed during addition. Moreover, these monomers may be added as they are or in the form of an emulsion obtained by mixing with water and/or a surfactant. As such a surfactant, one or more of the previously exemplified surfactants may be used.

During the seed emulsion polymerization process, an emulsifier (a surface active agent) may be added to the wax emulsion in a predetermined amount. A polymerization initiator may be added before, at the same time with or after the addition of the monomers. These addition methods may be employed in combination.

In another embodiment of the present invention, the primary polymer particles comprise units from a monomer having a Brönsted acid group or a Brönsted basic group. In another embodiment of the present invention, the particulate resin comprises units from a monomer having a Brönsted acidic group or a Brönsted basic group. In another embodiment of the present invention, the primary polymer particles comprise from 1 to 40 parts by weight of a wax therein based on 100 parts by weight of binder resin in the toner. In another embodiment of the present invention, the particulate resin of a non-outer layer comprises from 1 to 40 parts by weight of wax therein based on 100 parts by weight of binder resin in the toner.

Examples of the monomer having a Brönsted acidic group usable in the present invention include monomers having a carboxylic group such as acrylic acid, methacrylic acid, maleic acid, fumaric acid and cinnamic acid, monomers having a sulfonic group such as styrene sulfonate, and monomers having a sulfonic amide group such as vinyl benzene sulfonamide.

Particularly preferred monomers for the primary particles are acrylic acid or methacrylic acid.

Examples of the monomer having a Brönsted basic group include aromatic vinyl compounds having an amino group such as aminostyrene; monomers containing a nitrogen-containing heterocycle such as vinylpyridine and vinylpyrrolidone; and (meth)acrylic acid esters having an amino group such as dimethylaminoethyl acrylate and diethylaminoethyl methacrylate.

Further, these monomers having an acidic group and monomers having a basic group can be present as salts with respective counter ions.

The amount of monomer having a Brönsted acidic group or a Brönsted basic group in a monomer mixture used to prepare the primary polymer particles is preferably 0.05% by weight or more, more preferably 1% by weight or more. Further, the amount of monomers having an acidic or basic group is preferably 10% by weight or less, more preferably 5% by weight or less.

Examples of the other comonomers used herein include styrenes such as styrene, methylstyrene, chlorostyrene, dichlorostyrene, p-tert-butylstyrene, p-n-butylstyrene and p-n-nonylstyrene; and (meth)acrylic acid esters such as methyl acrylate, ethyl acrylate, propyl acrylate, n-butyl acrylate, isobutyl acrylate, hydroxyethyl acrylate, ethylhexyl acrylate, methyl methacrylate, ethyl methacrylate, propyl methacrylate, n-butyl methacrylate, isobutyl methacrylate, hydroxyethyl methacrylate and ethylhexyl methacrylate; acrylamide, N-propylacrylamide, N,N-dimethylacrylamide, N,N-dipropylacrylamide, N,N-dibutylacrylamide, and acrylic amide. Particularly preferred among these monomers are styrene, butyl acrylate.

Where a crosslinked resin is used as the primary polymer particles, as a crosslinking agent to be used together with the above-described monomers, radically polymerizable polyfunctional monomers can be used. Examples of such radically polymerizable polyfunctional monomers include divinyl benzene, hexanediol diacrylate, ethylene glycol dimethacrylate, diethylene glycol dimethacrylate, diethylene glycol diacrylate, triethylene glycol diacrylate, neopentyl glycol dimethacrylate, neopentyl glycol diacrylate and diallyl phthalate. Further, monomers having a reactive group in a pendant group, such as glycidyl methacrylate, methylol acrylamide and acrolein can be used.

Preferably, radically-polymerizable bifunctional monomers, more preferably, divinyl benzene and hexanediol diacrylate are desirably used.

The amount of such a polyfunctional monomer used in the monomer mixture is preferably 0.005% by weight or more, more preferably 0.05% by weight or more, even more preferably 0.1% by weight or more and particularly preferably 0.3% by weight or more. Further, the amount of polyfunctional monomer is preferably 5% by weight or less, more preferably 3% by weight or less, and particularly preferably 1% by weight or less.

The polyfunctional monomers may be used singly or in admixture, and are preferably added such that the resulting polymer exhibits a glass transition temperature of from 40° C. to 80° C. If the glass transition temperature of the polymer exceeds 80° C., the resulting toner exhibits too high a fixing temperature. Further, the toner may have a decreased OHP transparency. On the contrary, if the glass transition temperature of the polymer falls below 40° C., the storage stability of the toner deteriorates.

Examples of polymerization initiators that can be used include, but are not limited to, persulfates such as potassium persulfate, sodium persulfate and ammonium persulfate; redox initiators obtained by combining these persulfates as one component with reducing agents such as acidic sodium sulfite; water-soluble polymerization initiators such as hydrogen peroxide,4,4'-azobiscyanovaleric acid, t-butyl hydroperoxide and cumene hydroperoxide; redox initiators obtained by combining these water-soluble polymerization initiators as one component with reducing agents such as ferrous salt; benzoyl peroxide, and 2,2'-azobis-isobutylonitrile. These polymerization initiators may be added before, at the same time with or after the addition of the monomers. These addition methods may also be employed in combination.

In the present invention, any known chain transfer agent may be used, as desired. Suitable examples of chain transfer agents include, but are not limited to, t-dodecyl mercaptan, 2-mercaptoethanol, diisopropyl xanthogen, carbon tetrachloride, and bromotrichloromethane. These chain transfer agents may be used singly or in combination. The chain transfer agents may be used in an amount of from 0 to 5% by weight based on the weight of the polymerizable monomers used.

The primary polymer particles obtained as described above have a wax substantially encapsulated therein. The primary polymer particles can have any desired morphology, such as, core-shell type, phase separation type, occlusion type or combinations or mixtures thereof. A particularly preferred morphology is a core-shell type particle. Components other than wax, such as a pigment and a charge control agent, can be further used as seed so far as they don't depart from the scope of the present invention. Further, a colorant and a charge control agent dissolved or dispersed in wax can be used.

The volume-average particle diameter of the primary polymer particles can be any size, but is generally from 0.02 to 3 μm, preferably from 0.05 to 3 μm, more preferably from 0.1 to 2 μm and most preferably 0.1 to 1 μm. For the measurement of volume average particle diameter, for example, UPA (Ultra Particle Analyzer produed by Nikkiso Co., Ltd.) may be used. If the particle diameter is less than 0.02 μm, the agglomeration rate can be difficult to controlled. If the particle diameter exceeds 3 μm, the toner obtained by agglomeration may have too large a particle diameter to provide a high resolution toner.

In the present invention, primary polymer particles are agglomerated to form an agglomerate of particles. Within the context of the present invention, the agglomerate of particles can take the form of an agglomerate where the individual particles are still distinguishable to a unitary large particle where the individual primary particles have coalesced to the point of no longer being distinguishable and the entire spectrum of species therebetween. However, in a preferable embodiment, a particulate resin (as described below) is further adhered or fixed thereto to form a toner. In such a toner, the primary polymer particles or the particulate resin for coating an agglomerate of primary particles, or both have THF insoluble portions.

In the case where the wax content of the toner is desired to be increased and a particulate wax has not been used as seed, or a particulate wax having a small particle diameter is used, the agglomeration of the primary polymer particles can be performed in the presence of another particulate wax. However, if dispersibility of the particulate wax in the toner is taken into account, substantially all wax is preferably encapsulated in primary polymer particles.

In another embodiment of the present invention, the agglomerate of particles has a volume-average particle diameter from 2 to 11 μm.

In accordance with the present invention, in obtaining primary polymer particles, a particulate colorant can be used as seed together with a particulate wax in the emulsion polymerization. Alternatively, a colorant can be used by dissolving or dispersing in the monomer or wax. However, preferably, a particulate colorant is agglomerated together with primary polymer particles to form an agglomerate of particles, which is used as the core material of the toner. In this process, primary polymer particles comprising wax encapsulated therein are used. However, two or more kinds of primary polymer particles can be used, if desired or needed. As a colorant to be used here, any of inorganic pigments, organic pigments or organic dyes, or any mixture thereof can be used.

In a case where a crosslinked resin is used for primary polymer particles, the THF insoluble content of the primary polymer particles is generally 15 w/w % or more, preferably 20 w/w % or more, more preferably 25 w/w % or more. Additionally, the THF insoluble content is preferably 80% or less, more preferably 70% or less.

If the crosslinking degree is too low, offset may occur. Further, if the crosslinking degree is too high, OHP transparency may be decreased.

Among components constituting the primary polymer particles, a THF soluble component preferably has a molecular weight peak (Mp) of 30,000, more preferably 40,000 or more. Further, the Mp is preferably 150,000 or less, more preferably 100,000 or less.

When a crosslinked resin is used, a THF soluble component preferably has a molecular weight peak of 100,000 or less, more preferably 60,000 or less.

When the molecular weight peak is noticeably smaller than the above-described range, the offset property of the toner at high temperature side can be poor. When the molecular weight peak is noticeably larger than the above-described range, the offset property of the toner at low temperature may be deteriorated.

Among components constituting primary polymer particles, those soluble in tetrahydrofuran have a weight-average molecular weight (Mw) of preferably 30,000 or more, more preferably 80,000 or more, a weight-average molecular weight (Mw) of preferably 500,000 or less, more preferably 300,000 or less.

Colorant

In accordance with the present invention, preferably, primary polymer particles and primary colorant particles are simultaneously agglomerated to form an agglomerate of the particles, to provide a toner or a toner core material. Suitable colorant particles include inorganic or organic pigments and organic dyes, alone or in combination as desired. Specific examples of suitable colorants include known dyes and pigments such as aniline blue, phthalocyanine blue, phthalocyanine green, hansa yellow, rhodamine dye or pigment, chrome yellow, quinacridone, benzidine yellow, rose bengal, triallylmethane dye, monoazo dyes or pigments, disazo dyesor pigments, and condensed azo dyes or pigments. These dyes or pigments may be used singly or in admixture. If the toner of the present invention is a full-color toner, benzidine yellow, monoazo dyes or pigments or condensed azo dyes or pigments are preferably used as a yellow dye or pigment, quinacridone dyes or pigments or monoazo dyes or pigments are preferably used as a magenta dye or pigment, and phthalocyanine blue is preferably used as a cyan dye or pigment. The colorant is normally used in an amount of from 3 to 20 parts by weight based on 100 parts by weight of the binder resin used. In the context of the present invention, the term "binder resin" refers to the total of the resin constituting primary polymer particles and the resin constituting particulate resin (if present).

In one embodiment, a magenta colorant compound represented by the following formulae (I) or (II) is used in a toner of the present invention having a particulate resin coating. Namely a colorant compound represented by the formula (I) can desirably prepare a primary colorant particle dispersion and, therefore, the resulting toner can have a desirable hue. Since a compound represented by the formula (II) is likely to be positively charged, in the case where it is used for a negatively charged toner, the agglomerate of particles containing the colorant (toner core material) is coated with particulate resin so that the colorant is not exposed. Thus, the toner can be negatively charged. When a compound represented by the formula (I) or (II) is included in a toner obtained by an emulsion polymerization agglomeration method, a desirable magenta hue can be obtained. Thus, the compound represented by the formula (I) or (II) can be especially advantageous as the colorant of the toner of the present invention.

(I)

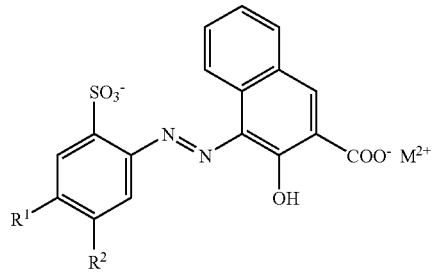

wherein $R^1$ and $R^2$ each independently represents a hydrogen atom, an alkyl group preferably having 1 to 8 carbons or a halogen atom, provided that at least one of $R^1$ and $R^2$ is a halogen atom, and M represents Ba, Sr, Mn, Ca or Mg.

(II)

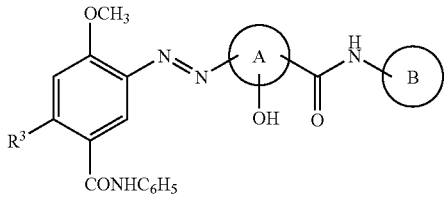

wherein A and B each, independently, represent an aromatic ring which can be substituted, and $R^3$ represents a hydrogen atom, a halogen atom, a nitro group, a cyano group, a hydrocarbon group having 1 to 5 carbon atoms, an alkoxy group having 1 to 5 carbon atoms, an aminosulfonyl group wherein the nitrogen atom may be substituted or an aminocarbonyl group wherein the nitrogen atom may be substituted.

In the general formula (II), A and B preferably represent a benzene ring or a naphthalene ring. Among compounds represented by formula (II), those represented by the following formula (IIa) are more preferred:

(IIa)

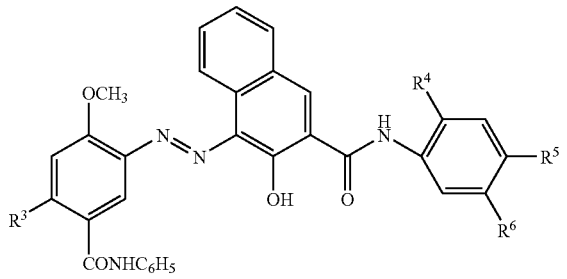

wherein $R^3$ to $R^6$ each independently represents a hydrogen atom, a halogen atom, a nitro group, a cyano group, a hydrocarbon group having 1 to 5 carbon atoms, an alkoxy group having 1 to 5 carbon atoms, an aminosulfonyl group wherein the nitrogen atom may be substituted or an aminocarbonyl group wherein the nitrogen atom may be substituted.

In the formula (IIa), the nitrogen atom of the aminosulfonyl group or aminocarbonyl group, can be substituted with an alkyl group, an aryl group, an alkoxyalkyl group, a haloalkyl group or a haloaryl group.

Further, a compound wherein $R^3$ is a hydrogen atom, $R^4$ is a methoxy group, $R^5$ is a hydrogen atom and $R^6$ is a chlorine atom is the most preferable in view of spectral reflectance, dispersibility in a polymerizable monomer and a processability to a colorant dispersion.

In the case where these colorants are used by emulsifying in water in the presence of an emulsifier to form an emulsion, those having a volume-average particle diameter of 0.01 to 3 μm are preferably used.

Charge Control Agent

In the present invention, a charge control agent can be included in the toner if desired. The charge control agent can be incorporated into the toner, preferably by a method wherein the charge control agent is used as seed together with wax in obtaining primary polymer particles, a method wherein the charge control agent is used by dissolving or dispersing in monomer or wax, or a method wherein primary polymer particles and primary charge control agent particles are agglomerated at the same time to form an agglomerate of particles, which is used as a toner. However, a preferable method comprises adhering or fixing a charge control particle before, during or after the process for adhering or fixing particulate resin. In this case, it is preferable that the charge control agent is also used as an emulsion in water having an average particle diameter of from 0.01 to 3 μm (primary charge control agent particles).

Any conventional charge control agent can be used alone or in combination of two or more. For example, a quaternary ammonium salt, and a basic electron-donating metal material are preferably used as a positively-charging charge control agent, and a metal chelate, a metal salt of an organic acid, a metal-containing dye, nigrosine dye, an amide group-containing compound, a phenol compound, a naphthol compound and the metal salts thereof, an urethane bond-containing compound, and an acidic or an electron-attractive organic substance are preferably used as a negatively-charging charge control agent.

Taking into account adaptability to color toner (the charge control agent itself is colorless or has a light color and hence doesn't impair the color tone of a toner), a quaternary ammonium salt compound is preferably used as a positively-charging charge control agent and a metal salt or metal complex of salicylic acid or alkylsalicylic acid with chromium, zinc or aluminum, a metal salt or metal complex of benzylic acid, amide compound, phenol compound, naphthol compound, phenolamide compound, and hydroxynaphthalene compound such as 4,4'-methylenebis[2-[N-(4-chlorophenyl)amide]-3-hydroxynaphthalene are preferably used as a negatively-charging charge control agent. The amount of the charge control agent to be used may be determined by the required charged amount of toner. In practice, however, it is normally from 0.01 to 10 parts by weight, preferably from 0.1 to 10 parts by weight, based on 100 parts by weight of the binder resin used.

Particulate Resin

Next, one important feature of the toner of the present invention resides in the formation of the toner particles by coating (adhering or fixing) a particulate resin over the above-described agglomerate of particles.

The particulate resin is used as an emulsion obtained by dispersing the same using an emulsifier (the above-described surface active agent) in water or a liquid mainly comprising water. For the particulate resin which is not used for the outermost layer of the toner, the above-described particulate resin obtained by emulsion polymerization using wax as seed is preferably used. However, as the particulate resin used for the outermost layer of the toner, a particulate resin substantially free of wax is used. In this case also, a particulate resin obtained by emulsion polymerization method is preferable. Within the context of the present invention the term "substantially free of wax" indicates that the level of wax is preferably less than 1 w/w %, more preferably less than 0.5 w/w %, most preferably less than 0.1 w/w %.

Preferred particulate resins, include those having a volume-average particle diameter of 0.02 to 3 μm, more preferably 0.05 to 1.5 μm. The particulate resin can comprise units obtained from the same monomers used to prepare the primary polymer particles or can use different monomers from those used in the primary particles.

When the toner is prepared by coating an agglomerate of particles with particulate resin, the particulate resin is preferably a crosslinked resin. In the present invention, it is most preferred that at least one of the primary polymer particles or particulate resin be crosslinked. As the crosslinking agent, the polyfunctional monomers used for the primary polymer particles can be used.

When the particulate resin is a crosslinked resin, the crosslinking degree is normally 5 w/w % or more, preferably 10 w/w % or more and more preferably 15 w/w % or more, based on measurements of THF insoluble content. More preferably, the particulate resin has a THF insoluble content of 70 w/w % or less. In order to achieve the above-described preferable range of THF insoluble content, the formulation amount of polyfunctional monomer is preferably 0.005% by weight or more, more preferably 0.01% or more and most preferably 0.05% or more, based on total monomer mixture used for preparing the particulate resin. Further, the amount of polyfunctional monomer is preferably 5% by weight or less, more preferably 3% by weight or less, and most preferably 1% by weight or less, based on total monomer mixture.

Among components of the particulate resin, a molecular peak (Mp) of THF-soluble components is preferably 30,000 or more, more preferably 40,000 or more, and is preferably 150,000 or less, more preferably 100,000 or less.

Particularly, in the case where a crosslinked resin is used, a molecular peak (Mp) of THF-soluble components is preferably 100,000 or less, more preferably 60,000 or less.

Among components of the particulate resin, a weight-average molecular weight (Mw) of THF-soluble components is preferably 30,000 or more, more preferably 50,000 or more, preferably 500,000 or less, more preferably 300,000 or less.

When the toner is coated with a particulate resin, however, the resulting toner can have a core-shell construction (with the primary polymer particles and colorant particles agglomerated in the core and the particulate resin coated on the outside) or it is also possible the during the aging of the toner with the particulate resin present, there is migration of particulate resin into the agglomerate with concomitant migration of the primary polymer particles and/or colorant particles into the outside coating layer. This can result in the outer layer containing slight amounts of primary polymer particles and colorant particles or even in the extreme, in a toner that is homogeneous with respect to primary polymer particles, colorant particles and particulate resin. All embodiments between distinct layers and homogeneous toner are included in the present invention.

In the case where the toner is a negatively charged toner, it is preferred to have the agglomerate coated with the particulate resin. If aging of the particulate resin coated agglomerate results in mixing to the point wherein no boundary exists between the agglomerate and the particulate resin, it is further preferred to provide an outer layer of particulate resin only.

Additionally, even when there is a distinct layer on the agglomerated primary polymer particles and colorant particles, the layer can completely cover the agglomerate or can be on a substantial portion, either continuously or non-continuously. Preferably, the particulate resin forms a coating on at least 75% of the surface area of the agglomerate, more preferably at least 85%, even more preferably at least 95%. Most preferably is a complete covering of the agglomerate with the particulate resin.

Agglomeration Process

In a preferred embodiment of the present invention, the above-described primary polymer particles, primary colorant particles, and optionally particulate charge control agent, particulate wax and other additives are emulsified to form an emulsified liquid, which are co-agglomerated to form an agglomerate of particles. Among respective components to be agglomerated, the charge control agent dispersion, particulate wax or other additives can be added during the agglomeration process or after the agglomeration process.

Embodiments of the agglomeration process include 1) methods wherein agglomeration is effected by heating, and 2) methods wherein agglomeration is effected chemically, such as by addition of an electrolyte.

In the case where agglomeration is effected by heating, the agglomeration temperature is preferably in a range of from 5° C. to Tg (Tg is the glass transition temperature of primary polymer particles), more preferably a range of from (Tg−10° C.) to (Tg−5° C.). By employing this preferred temperature range, a desirable toner particle diameter can be obtained by agglomeration without using a chemical additive, such as an electrolyte.

In the case where agglomeration is effected by heating, the method can further comprise an aging step subsequent to the agglomeration step. The aging step is described in more detail below. The agglomeration step and the aging step are effected sequentially and, therefore, the boundary between these processes is not necessarily clear cut. However, a process wherein a temperature range of from (Tg−20° C.) to Tg is maintained for at least 30 minutes is defined herein as an agglomeration step.

The agglomeration temperature is preferably a temperature at which toner particles having a desired particle diameter are formed, by keeping the mixture for at least 30 minutes at the given temperature. To reach the given temperature, temperature can be elevated at a constant speed or stepwise. The holding time is preferably from 30 minutes to 8 hours, more preferably from 1 hour to 4 hours in a temperature range of from (Tg−20° C.) to Tg. Thus, a toner having a small particle diameter and sharp particle size distribution can be obtained.

In the process of the present invention, the particulate resin and/or particulate charge control agent can each, independently, be added to the process before or during the agglomeration step, between the agglomeration step and aging step, during the aging step or after the aging step. Further, if either component is added after the aging step, a second aging step can be performed if desired, under the same conditions noted above for the aging step.

In the case where agglomeration is effected by use of electrolyte, the electrolyte can be combined with a mixed dispersion of primary polymer particles, colorant particles, and optionally other components. Suitable electrolytes can be organic salts or inorganic salts. A monovalent or polyvalent (divalent or more) metal salt is preferable. Specifically, mention may be made of NaCl, KCl, LiCl, $Na_2SO_4$, $K_2SO_4$, $Li_2SO_4$, $MgCl_2$, $CaCl_2$, $MgSO_4$, $CaSO_4$, $ZnSO_4$, $Al_2(SO_4)_3$, $Fe_2(SO_4)_3$, $CH_3COONa$ and $C_6H_5SO_3Na$.

The amount of electrolyte to be added varies depending on the particular one chosen, and is, in practice, used in an amount of from 0.05 to 25 parts by weight, preferably from 0.1 to 15 parts by weight, more preferably from 0.1 to 10 parts by weight based on 100 parts by weight of the solid content of mixed dispersion used (wherein the mixed dispersion comprises, at least primary polymer particles and colorant particles).

If the amount of electrolyte to be added is significantly smaller than the above-described range, various problems tend to occur. Namely, the agglomeration reaction proceeds so slowly that finely divided particles having a diameter of not more than 1 μm are left behind after the agglomeration reaction or the average particle diameter of the aggregates of particles thus obtained is not more than 3 μm. Further, if the amount of electrolyte added significantly exceeds the above-described range, various other problems also can occur. Namely, the agglomeration reaction may proceed too rapidly to control. The resulting agglomerate of particles contains coarse particles having a particle diameter of not less than 25 μm or have an irregular amorphous form.

Further, in the case where agglomeration is effected by adding an electrolyte, the agglomeration temperature is preferably in the range of from 5° C. to Tg.

As noted above, in order to enhance the stability of the aggregates (toner particles) obtained in the agglomeration step, an aging step (causing the fusion of agglomerated particles to each other) at a temperature of from Tg to (Tg+80° C.), preferably (Tg+20° C.) to (Tg+80° C.), but below the softening point temperature of the primary polymer particles may be preferably added. The addition of the aging step makes it possible to substantially round the shape of the toner particles or control the shape of the toner particles. This aging step is normally performed for a time of from 1 hour to 24 hours, preferably from 1 hour to 10 hours.

The agglomeration step can be performed in any suitable apparatus, but is preferably performed in a reaction tank with agitation. Substantially cylindrical or spherical reaction tanks are preferably used. When the reaction tank is substantially cylindrical, the shape of the bottom thereof is not particularly limited. However, generally a reaction tank having a substantially circular bottom is preferably used.

In order to improve agitation efficiency, the volume of the mixed dispersion is preferably 3/4 or less, preferably 2/3 or less of the volume of the reaction tank. When the volume of the mixed dispersion is significantly smaller than that of the reaction tank, the dispersion bubbles violently, increasing the viscosity. As a result, coarse particles tend to be formed, agitation sometimes cannot occur effectively depending upon the shape of an agitating blade, and, the productivity is lowered. Thus, the above-described volume ratio is preferably 1/10 or more, more preferably 1/5 or more.

As an agitating blade to be used in the agglomeration step, any agitating blade can be used, such as conventionally known commercially available agitating blades. Suitable commercially available agitating blades, include anchor blades, full zone blades (produced by Shinko Pantec Co., Ltd.), Sunmeler blades (produced by Mitsubishi Heavy Industries, Ltd.), Maxblend blades (Sumitomo Heavy Industries, Ltd.), Hi-F mixer blades (produced by Souken Kagaku K. K.) and double helical ribbon blades (produced by Shinko Pantec Co., Ltd.). A baffle may also be provided in the agitating tank if desired.

Generally, the agitating blade is selected and used depending upon the viscosity and other physical properties of the reaction liquid, the reaction itself, and the shape and size of the reaction tank. Such selection is within the skill of the ordinary artisan. As a preferred agitating blade, however, specific mention may be made of a double helical ribbon blade or anchor blade.

The Other Additives

The toner according to the present invention can be used together with one or more other additives such as a fluidity improver as desired. Specific examples of such fluidity improvers include finely divided hydrophobic silica powder, finely divided titanium oxide powder and finely divided aluminum oxide powder. The fluidity improver is, when present, normally used in an amount of from 0.01 to 5 parts by weight, preferably from 0.1 to 3 parts by weight based on 100 parts by weight of the binder resin used.

Further, the toner according to the present invention may contain an inorganic particulate material such as magnetite, ferrite, cerium oxide, strontium titanate and electrically conductive titania or a resistivity adjustor or lubricant, such as styrene resin or acrylic resin, as an internal or external additive. The amount of such an additive to be added may be properly predetermined depending on the desired properties. In practice, however, it is preferably from 0.05 to 10 parts by weight based on 100 parts by weight of the binder resin used.

The toner of the present invention may be in the form of either a two-component developer or a non-magnetic one-component developer. The toner of the present invention, if used as a two-component developer, may have any known carrier such as magnetic materials (including iron powders, magnetite powders, ferrite powders,) materials obtained by coating the surface of such a magnetic material with a resin and magnetic carriers. As the coating resin to be used in the resin-coated carrier there may be used generally known resins, such as styrene resin, acrylic resin, styrene-acryl copolymer resin, silicone resin, modified silicone resin, fluororesin or mixture thereof.

Toner

The toner of the present invention produced by using the above-described respective components, comprises a resin wherein at least one of primary polymer particles or particulate resin are crosslinked. When a crosslinked resin is used, the THF insoluble content is high. When an uncrosslinked resin is used, it is substantially dissolved in THF. Generally, the colorant is not THF soluble. Further, although the charge control agent is sometimes THF-soluble and sometimes THF insoluble, the charge control agent is used in a small proportion compared with the other components. By taking these facts into consideration, the THF insoluble content of the toner of the present invention is controlled in a range of from 15 to 80 w/w %. The tetrahydrofuran insoluble content is preferably 20 w/w % or more, and is preferably 70 w/w % or less.

In the toner of the present invention when both primary polymer particles and particulate resin are crosslinked, which is a most preferred embodiment of the present invention, the THF insoluble content of the toner is 20 to 70 w.w %, preferably 30 to 70 w/w %.

The toner of the present invention further comprises wax, preferably a wax having a melting point of 30 to 100° C. The content thereof in the toner is preferably 1 part by weight or more, more preferably 5 parts by weight or more and particularly preferably 8 parts by weight or more to 100 parts by weight of a binder resin of the toner (wherein the term "binder resin" is used herein to mean the sum of the resin constituting primary polymer particles and the resin constituting particulate resin, as described earlier). The wax content is also preferably 40 parts by weight or less, more preferably 35 parts by weight or less and most preferably 30 parts by weight or less.

When the toner of the present invention is used in a printer or a copying machine having high resolution, the toner preferably has a relatively small particle size and has a sharp particle size distribution for attaining a uniform charged amount in respective toner particles.

The average volume particle diameter of the toner of the present invention is preferably 3 to 12 μm, more preferably 4 to 10 μm, particularly preferably 5 to 9 μm. As an index representing particle size distribution, the ratio of volume-average particle diameter ($D_V$) to number-average particle diameter ($D_N$), i.e., (($D_V$)/($D_N$)) is used. The present invention toner preferably has a ($D_V$)/($D_N$) of 1.25 or less, more preferably 1.22 or less and most preferably 1.2 or less. The minimum ($D_V$)/($D_N$) is 1, which means that all particles have the same particle size. This is advantageous in the formation of an image having a high resolution. Practically, however, a particle size distribution of 1 is extremely difficult to be obtained. Accordingly, in view of production considerations, ($D_V$)/($D_N$) is preferably 1.03 or more, more preferably 1.05 or more.

When finely divided powder (toner having excessive small particle diameter) is present in too high an amount, blushing of a sensitizing body and scattering of toner into the inside of an apparatus are likely to occur and the charged amount distribution is also liable to be worse. When coarse powder (toner having excessive large particle diameter) is present in too high an amount, the charged amount distribution is liable to be worse, which is unsuitable for forming a high resolution image. For example, when the toner has an average volume particle diameter of 7 to 10 μm, the amount of toner having a particle diameter of 5 μm or less is preferably 10% by volume or less, more preferably 5% by volume or less of the entire amount of the toner. The amount of toner having a particle diameter of 15 μm or more is preferably 5% by volume or less, more preferably 3% by volume or less.

When such a toner having a relatively small particle diameter and a sharp particle size distribution is produced, the production method according to the emulsion polymerization agglomeration method of the present invention is advantageous compared with suspension polymerization or kneading-pulverizing method.

The 50% circular degree of the present toner is preferably 0.95 or more, more preferably 0.96 or more. (circular degree=circumference length of circle having the same area as that of projected area of particle/circumference length of projected image of particle) The maximum 50% circular degree is 1 which means that the toner is substantially spherical. However, such a toner is difficult to be obtained. Thus, in view of production considerations, it is preferably 0.99 or less.

Preferred Embodiments of the Invention

The toner of the present invention has a construction such that at least one layer of a particulate resin is coated over the above-described agglomerate of particles. In this construction, at least one of the primary polymer particles and the particulate resin contains wax encapsulated therein, while the particulate resin in the outermost layer is substantially free of wax.

Here, preferable several examples of embodiments of the toner of the present invention will be specifically described below.

A first preferred embodiment of the toner of the present invention is one wherein one layer of a particulate resin is coated on an agglomerate of particles comprising primary polymer particles having wax encapsulated therein and the one layer of the particulate resin is substantially free of wax.

Among constructions of the toner of the present invention, this construction is the most simple and is advantageous in view of the production of the toner.

In this embodiment, as shown in FIG. 1, at least one row of particulate resin is preferably coated over a substantial portion of the surface of an agglomerate of particles (In FIGS. 1 to 5, only primary polymer particles and a particulate resin are shown. A particulate colorant, a particulate charge control agent and the other additives are not shown, but could be present as desired). It should be noted in the present specification that in a case where the same kind of particulate resin is coated (adhered or fixed), the particulate resin is defined as one layer regardless of whether one row or plural rows of the particulate resin have actually been coated.

In another embodiment of the present invention, the agglomerate of particles and the particulate resin coating the agglomerate are present in a ratio by weight (weight of the agglomerate of particles/weight of the particulate resin) of from 1 to 100.

When a particulate resin is used in an extremely small amount, it sometimes cannot provide coating effects. Thus, the coating amount is preferably 3 w/w % or more, more preferably 5 w/w % or more of primary polymer particles. Contrary to this, when it is used in an extremely large amount, wax is not to be present in the surface site except for the outermost layer, which may result in poor discharge of wax from the toner at the time of fixing. Thus, the coating amount is preferably 80% or less, more preferably 40% or less, and particularly preferably 20% or less of primary polymer particles.

Prior to coating a particulate resin over an agglomerate of particles, the agglomerate can be fusion bonded at a temperature of the glass transition temperature of the primary polymer particles (Tg) or more, preferably Tg to (Tg+80° C.). In a case where prior to coating a particulate resin, an agglomerate of particles is fusion bonded, followed by coating the particulate resin, a toner is to have a morphology similar to that shown in FIG. 2. Alternatively, it is possible that a particulate resin is adhered to an agglomerate of particles having not been subjected to fusion-bonding, then the agglomerate of particles and the particulate resin is fusion-bonded.

Figure 3:
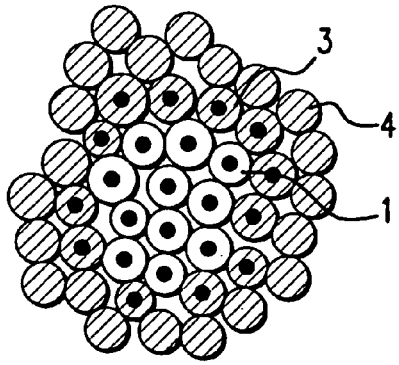
FIG. 3 is a schematic representation of a toner having an agglomerate of primary polymer particles and an inner layer of particulate resin coated thereon, wherein both the agglomerate and inner layer contain a wax, which is further covered by a layer of particulate resin substantially free of wax.

As shown in FIG. 3, a second preferred embodiment of the toner of the present invention is one wherein two layers of a particulate resin are coated onto an agglomerate of particles comprising the primary polymer particles having a wax therein. The particulate resin of the inner layer also contains wax therein, and the particulate resin of the outer layer is substantially free of wax.

This construction is advantageous in that corresponding to a material of a fixing apparatus and a fixing temperature, glass transition temperature (Tg) or crosslinking degree of a particulate resin of the inner layer or the outer layer can be varied, and the amount and type of wax included in primary polymer particles or in the inner layer of particulate resin can be varied.

The amount of particulate resin in the outer layer is preferably 3 w/w % or more, more preferably 5 w/w % or more relative to the sum of the particulate resin in the inner layer and primary polymer particles, and is preferably 80% or less, more preferably 40% or less and particularly preferably 20% or less of the same sum.

Also in this case, prior to coating an inner layer of particulate resin over an agglomerate of particles, the agglomerate can be fusion bonded at a temperature of the glass transition temperature of the primary polymer particles (Tg) or more, preferably Tg to (Tg+80° C.). Further, prior to coating the particulate resin of the outer layer, the agglomerate and the particulate resin of the inner layer can be fusion bonded with each other. Alternatively, the particulate resin of the inner layer and that of the outer layer are adhered to the agglomerate of particles having not been subjected to fusion-bonding, then the agglomerate of particles and the particulate resin of the inner layer and the outer layer can be fusion-bonded to each other.

Figure 4:
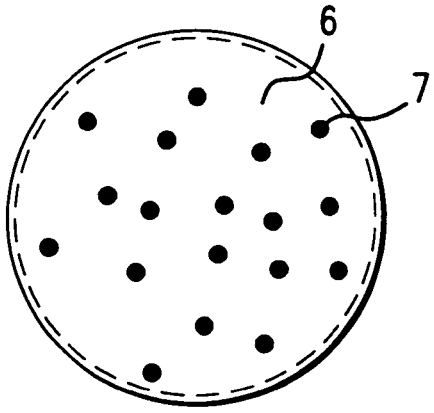
FIG. 4 is a schematic representation of a toner wherein both primary polymer particles and particulate resin are fusion-bonded.

FIG. 4 is a schematic view of a toner having been subjected to fusion-bonding in the above-described first and second embodiments. As shown in FIG. 4, in the toner having this structure, in the outermost part of the toner, specifically in the area of the depth of 0.1 μm from the surface of the toner, there is no substantial amount of wax particles, while in the inside of the toner, a particulate wax is present at a relatively constant distribution.

"Substantially free of wax particles" means that in observing the cross section of a toner by a transmission type electron microscope (TEM) photograph, wherein the toner has a volume-average particle diameter of from 3 to 12 μm, a half value width of a number-average particle diameter of particulate wax contained therein, when the cross section of the toner is observed, of 0.06 μm or less, and wherein the distribution of particulate wax having an average particle diameter of 0.01 μm or more throughout the toner particle satisfies the following equation:

$$(A/B)/(C/D) \leqq 0.1$$

wherein A is total area of wax particles contained in outermost layer to a depth of 0.1 μm;

B is total area of outermost layer;

C is total area of wax particles contained in remainder of toner particle (at a depth of greater than 0.1 μm from the surface of the particle); and D is total area of said remainder of toner particle, wherein all areas are measured as observed in a cross section of said toner particle through a center point of said toner particle.

Figure 6:
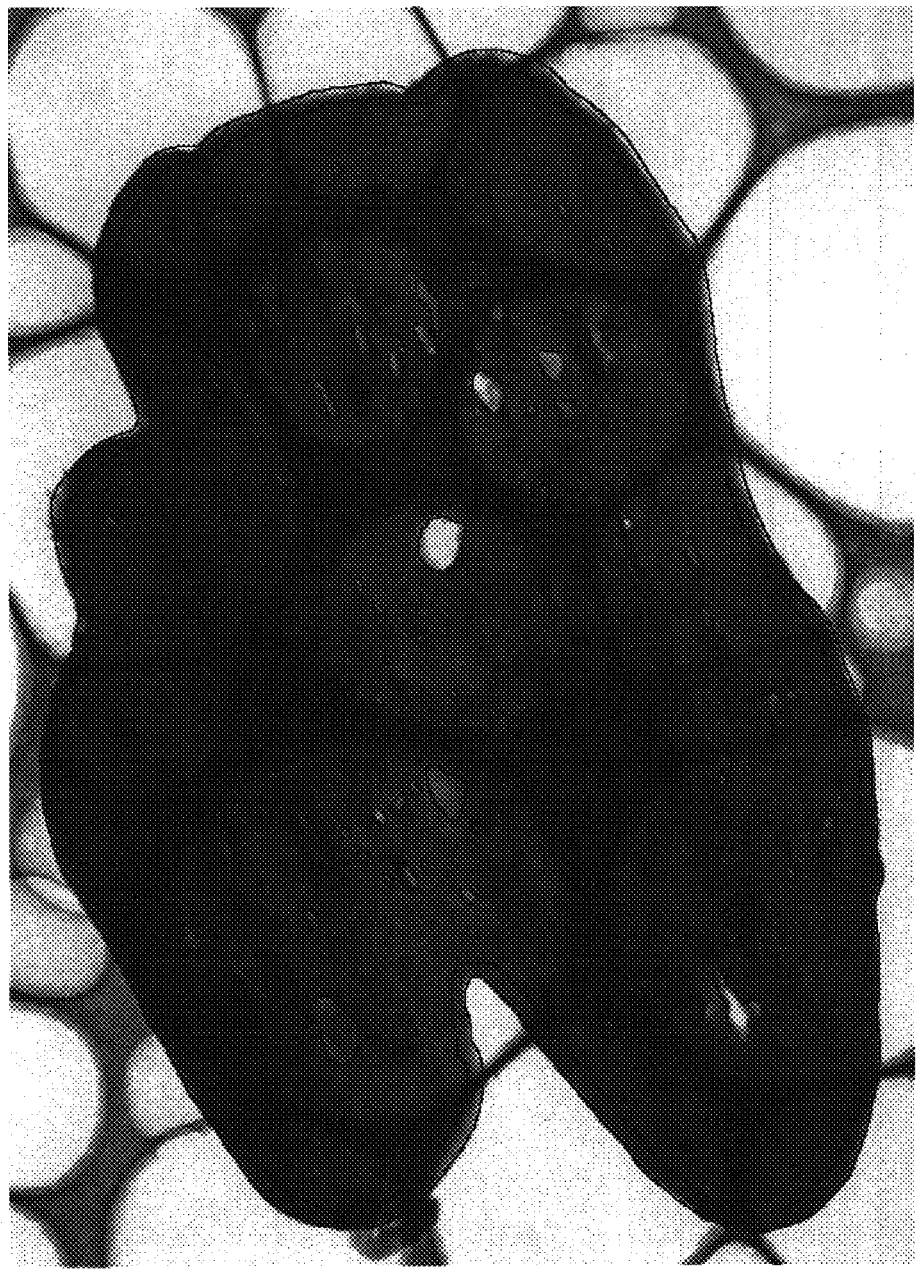
FIG. 6 is a TEM photograph of the cross section of the toner obtained in Example 1.

FIG. 6 is the TEM photograph of the cross section of the toner produced in Example 1. The observation of the cross section of the toner by this photograph shows that a particle of a particulate wax is not always cut along the face passing through the center, but is rather cut along a surface deviated from the center. Accordingly, the value of the particle diameter obtained from the particulate wax observed in the cross section of the toner (observed in the flat state) is smaller than the particle diameter of the particulate wax practically present in the toner. Further, when a toner particle is cut, some strength is exerted to the toner and, therefore, even when a substantially spherical toner is cut, the cut surface cannot be circular, but generally will be a broken ellipse. Thus, the cross section of a particulate wax included in the toner is also to be a broken ellipse.

A number-average particle diameter of a particulate wax observed in the cross section of a toner is generally 20 nm or more, preferably 30 nm or more, more preferably 50 nm or more, and is generally 150 nm or less, preferably 100 nm or less.

In the present invention, a particulate wax is used as seed of primary polymer particles or a particulate resin. Thus, the wax is encapsulated in the resin. Therefore, even in a case where during the production of a toner, an agglomerate of particles is fusion bonded, the particulate wax is considered substantially to maintain the particle diameter at a time when present in the primary polymer particles or the particulate resin. In the case where a particulate wax is co-agglomerated with primary polymer particles, the particulate wax sometimes can be preferentially fusion-bonded with each other in the course of the co-agglomeration. Thus, the wax can have a particle diameter from the initial particle diameter to a fairly large particle diameter resulted from repeated fusion-bonding of multiple wax particles. Accordingly, the distribution of the number-average particle diameter of the particulate wax observed in the cross section of the toner where the particulate wax and primary polymer particles are co-agglomerated is wider than that in the case where primary polymer particles obtained by seed polymerization are agglomerated.

In the toner of the present invention, a half value width in a number-average particle diameter of a particulate wax observed in the cross section of the toner is preferably 0.06 μm or less, more preferably 0.05 μm or less. The theoretical minimum value of the half value width is 0. However, such a particulate wax cannot be produced practically. Thus, a practical half value width is 0.01 μm or more.

In FIG. 4, the dotted line shows the depth of 0.1 μm from the surface of a toner. In the fusion-bonded toner, commonly, the boundary between a portion which was primary polymer particles and a portion which was particulate resin cannot be clearly recognized, since some migration of the polymers can occur during fusion bonding.

Inside the toner of the present invention, a large number of small particle diameter particulate wax particles are distributed. In such a structure, wax can be uniformly discharged from the toner surface during of fixing. Thus, the toner has excellent releasability. Further, before fixing the toner, the discharge of wax is suppressed so that the toner is also excellent in blocking resistance and the apparatus is hardly polluted.

Figure 5:
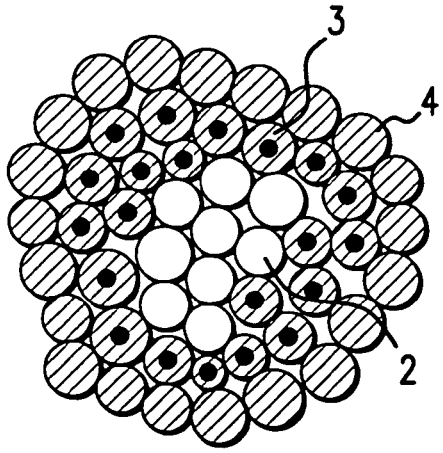
FIG. 5 is a schematic representation of a toner wherein a particulate resin having wax encapsulated therein is covered over an agglomerate of primary polymer particles that are substantially free of wax, and a further layer of particulate resin substantially free of wax is coated thereon.

As shown in FIG. 5, a third preferred embodiment of the toner of the present invention is a toner for the development of an electrostatic image wherein two layers of a particulate resin are coated onto an agglomerate of particles comprising at least primary polymer particles, wherein the primary polymer particles do not comprise wax therein, the particulate resin of the inner layer does comprise wax therein, and the particulate resin of the outer layer is substantially free of wax.

This construction is also advantageous as in the second embodiment in that corresponding to a material of a fixing apparatus and a fixing temperature, glass transition temperature (Tg) or crosslinking degree of the particulate resin of the inner layer or the outer layer can be varied.

The amount of particulate resin in the outer layer is preferably 3 w/w % or more, more preferably 5 w/w % or more, relative to the sum of the particulate resin in the inner layer and primary polymer particles. The amount of particulate resin in the outer layer is also preferably 80% or less, more preferably 40% or less and particularly preferably 20% or less, relative to the same sum.

In this embodiment, since the primary polymer particles are substantially free of wax, the wax-free primary polymer particles and the particulate wax are preferably co-agglomerated to form an agglomerate of particles.

Of the above-described three preferred embodiments, the first and second embodiments are more preferred in the point that the particulate wax is uniformly distributed in the toner.

Further, in the present invention, as long as the particulate resin in the outermost layer is substantially free of wax, it is also possible to coat three or more layers of the particulate resin onto the agglomerate of particles to form the toner. For example, by controlling crosslinking degree or Tg of the toner, the toner preferably has a hardness gradient, i.e., the toner is harder from the inside toward the outside (softer inside, harder outside).

The toner of the present invention preferably uses a resin wherein at least one of primary polymer particles and particulate resin is crosslinked. The use of a resin wherein both primary polymer particles and particulate resin are crosslinked is particularly preferable.

In the case where a crosslinked resin is used, the toner has a THF insoluble content of preferably 15 to 80% by weight, more preferably 20 to 80% by weight.

In the case where wherein both primary polymer particles and the particulate resin are crosslinked, which is a most preferred embodiment of the present invention, the toner has a THF insoluble content of preferably 15 to 80% by weight, more preferably 20 to 80% by weight.

Having generally described this invention, a further understanding can be obtained by reference to certain specific examples which are provided herein for purposes of illustration only and are not intended to be limiting unless otherwise specified.

EXAMPLES

The present invention will be further described in the following examples.

The term "parts" as used hereinafter is meant to indicate "parts by weight". For the measurement of the average particle diameter, weight-average molecular weight, glass transition temperature (Tg), 50% circular degree, fixing temperature width, charged amount and blocking resistance of the polymer particles, the following methods were used.

Volume-average particle diameter, number-average particle diameter, proportion of toner particles having a diameter of 5 μm or less and those having a diameter of 15 μm or more: LA-500 produced by Horiba K.K., Microtrack UPA produced by Nikkiso Co., Ltd. or COULTER COUNTER MULTISIZER II model (abbreviated as Coulter Counter) produced by Coulter Inc. were employed.

Weight-average molecular weight (Mw), Molecular weight peak (Mp): Gel permeation chromatography (GPC) was employed (apparatus: GPC apparatus HLC-8020 produced by Tosoh Corporation, column: PL-gel Mixed-B 10μ produced by Polymer Laboratory K.K., solvent: THF, sample concentration: 0.1 wt %, calibration curve: standard polystyrene).

Glass transition temperature (Tg): DSC 7 produced by Perkin Elmer Inc. was used (Temperature of toner was elevated from 30° C. to 100° C. for 7 minutes, then the temperature was quickly lowered from 100° C. to −20° C., successively elevated from −20° C. to 100° C. for 12 minutes. The value of Tg observed at the second temperature elevation was adopted).

50% circular degree: Toner was evaluated by flow type particle image analysis apparatus FPIA-2000 produced by Sysmex Corporation and circular degree corresponding to cumulative particle size value at 50% of the value determined by the following formula was employed.

Circular degree=circumference length of circle having the same area as that of projected area of particle/circumference length of projected image of particle.

Fixing temperature width: A recording paper having an unfixed toner image supported thereon was prepared. The recording paper was carried into the fixing nip during which the surface temperature of heated rollers was varied from 100° C. to 220° C. The recording paper discharged from the fixing nip was then observed for fixing conditions. The temperature range within which the heated rollers undergo no toner offset during fixing and the toner which has been fixed to the recording paper was sufficiently bonded to the recording paper was defined as fixing temperature width.

The heated rollers in the fixing machine comprise aluminum as core metal, 1.5 mm-thick dimethyl type low temperature vulcanizable silicone rubber having a rubber hardness of 3° according to JIS-A specification as a resilient layer, a 50 μm-thick releasing layer comprising PFA (tetrafluoroethylene-perfluoroalkylvinyl ether copolymer). The roller has a diameter of 30 mm and a rubber hardness on the fixing roller surface determined according to Japan rubber association specification SRIS 0101 of 80. Evaluation was effected under conditions of a nip width of 4 mm and fixing rates of 120 mm/s or 30 mm/s, without coating the roller with silicone oil.

It should be noted that since the evaluation range is 100 to 220° C. (in Comparative Example 10, 100 to 200° C.), a toner described to have the upper limit of a fixing temperature of 220° C. has a possibility of having a true upper limit of a fixing temperature which is higher than 220° C.

OHP transparency: By using the above-described fixing rollers, unfixed toner image in the form of OHP sheet was fixed under the conditions of a fixing rate of 30 mm/s and 180° C., without coating silicone oil. Then, the transmittance was determined in a range of wavelength of from 400 nm to 700 nm by means of a spectrophotometer (U-3210 produced by Hitachi Seisakusho K.K.). The difference between the transmittance at the wavelength at which the highest transmittance was observed (maximum transmittance (%)) and the transmittance at the wavelength at which the lowest transmittance was observed (minimum transmittance (%)) (maximum transmittance (%)—minimum transmittance (%)) was employed as OHP transparency.

Charged amount: Toner was charged into a non-magnetic one-component developing cartridge COLOR PAGE PRESTO N4 developing cartridge, manufactured by Casio Co., Ltd.), then rollers were revolved for a predetermined period, thereafter, the toner on the roller was sucked. An charged amount per unit weight was determined from the charged amount (determined by BLOWOFF produced by Toshiba Chemical Corp.) and the weight of the sucked toner.

Blocking resistance: A 10 g amount of a toner for development was placed into a cylindrical container, then 20 g of load was applied thereto, which was allowed to stand in a circumstance of 50° C. for 5 hours. Thereafter, the toner was taken out from the container and an agglomeration degree was confirmed by applying a load from the above thereto.

A: Agglomeration was not observed

B: Although agglomeration occurred, it was broken by applying a light load.

NG: Agglomeration was formed, which was not broken by applying a load.

Tetrahydrofuran insoluble matter: The determination of insoluble matters in tetrahydrofuran of toner, primary polymer particles and particulate resin were effected as follows: A 1 g amount of a sample was added to 50 g of tetrahydrofuran, the resulting mixture was dissolved by allowing to stand at 25° C. for 24 hours, successively filtered with 10 g of Celite. The solvent of the filtrate was distilled off and an amount of the matter soluble in tetrahydrofuran was quantitatively determined. The value obtained was subtracted from 1 g, whereby the amount insoluble in tetrahydrofuran was calculated.

Melting Point of Wax: Determination was effected at a temperature elevation rate of 10° C./min. using DSC-20 produced by Seiko Instruments Inc. The temperature of the peak which shows maximum endotherm in DSC curve was employed as the melting point of wax.

Example 1

(Wax Dispersion 1)

A 68.33 part amount of desalted water, 30 parts of 7:3 mixture of an ester mixture mainly comprising behenyl behenate (UNISTER M2222SL, produced by NOF Corporation) and an ester mixture mainly comprising staryl starate (UNISTER M9676, produced by NOF Corporation) and 1.67 parts of sodium dodecylbenzene sulfonate (NEOGEN SC, produced by Dai-ichi Kogyo Seiyaku Co., Ltd., 66% of active component) were mixed, then the resulting mixture was emulsified at 90° C. by applying high pressure shearing to obtain a dispersion of particulate ester wax. An average particle diameter of the particulate ester wax determined by LA-500 was 340 nm.

(Primary Polymer Particle Dispersion 1)

Into a reactor (volume 60 liter, inner diameter 400 mm) equipped with an agitator (three blades), a heating condenser, a concentrating apparatus and an apparatus for charging starting materials and auxiliaries were charged wax dispersion 1 28 parts, 15% aqueous solution of Neogen SC 1.2 parts and desalted water 393 parts, which were then heated to a temperature of 90° C. in a flow of nitrogen. Successively, 8% aqueous hydrogen peroxide 1.6 parts and 8% aqueous ascorbic acid 1.6 parts were added thereto.

Thereafter, to the mixture obtained a mixture of the following monomers and aqueous solution of emulsifier was added for 5 hours from the initiation of polymerization and aqueous polymerization initiator was added for 6 hours from the initiation of polymerization. The resulting reaction mixture was further kept for 30 minutes.

| | |
|---|---|
| [Monomers] | |
| Styrene | 79 parts (5530 g) |
| Butyl acrylate | 21 parts |
| Acrylic acid | 3 parts |
| Octane thiol | 0.38 part |
| 2-mercaptoethanol | 0.01 part |
| Hexanediol diacrylate | 0.9 part |
| [Aqueous solution of emulsifier] | |
| 15% aqueous solution of Neogen SC | 1 part |
| Desalted water | 25 parts |
| [Aqueous polymerization initiator] | |
| 8% aqueous hydrogen peroxide | 9 parts |
| 8% aqueous ascorbic acid | 9 parts |

After the completion of the polymerization reaction, the resulting product was cooled to obtain an opaque white polymer dispersion. The weight-average molecular weight of the soluble matter in THF of the polymer was 119,000, the average particle diameter determined by UPA was 189 nm and Tg was 57° C.

(Particulate Resin Dispersion 1)

Into a reactor (volume 60 liter, inner diameter 400 mm) equipped with an agitator (three blades), a heating condenser, a concentrating apparatus and an apparatus for charging starting materials and auxiliaries were charged 15% aqueous solution of NEOGEN SC 5 parts and desalted water 372 parts, which were then heated to a temperature of 90° C. in a flow of nitrogen. Successively, 8% aqueous hydrogen peroxide 1.6 parts and 8% aqueous ascorbic acid 1.6 parts were added thereto.

Thereafter, to the mixture obtained a mixture of the following monomers and aqueous solution of emulsifier was added for 5 hours from the initiation of polymerization and aqueous polymerization initiator was added for 6 hours from the initiation of polymerization. The resulting reaction mixture was further kept for 30 minutes.

| | |
|---|---|
| [Monomers] | |
| Styrene | 88 parts (6160 g) |
| Butyl acrylate | 12 parts |
| Acrylic acid | 2 parts |
| Bromotrichloromethane | 0.5 part |
| 2-mercaptoethanol | 0.01 part |
| Hexanediol diacrylate | 0.4 part |

-continued

| | |
|---|---|
| [Aqueous solution of emulsifier] | |
| 15% aqueous solution of Neogen Sc | 2.5 parts |
| Desalted water | 24 parts |
| [Aqueous polymerization initiator] | |
| 8% aqueous hydrogen peroxide | 9 parts |
| 8% aqueous ascorbic acid | 9 parts |

After the completion of the polymerization reaction, the resulting product was cooled to obtain an opaque white polymer dispersion. The weight-average molecular weight of the soluble matter in THF of the polymer was 54,000, the average particle diameter determined by UPA was 83 nm and Tg was 85° C.

(Particulate Colorant Dispersion 1)

Aqueous dispersion of pigment blue 15:3 (EP-700 BLUE GA, produced by Dainichiseika Color & Chemicals Mfg. Co., Ltd., solid content 35%), an average particle diameter determined by UPA of 150 nm.

(Particulate Charge Control Agent Dispersion 1)

A 20 part amount of 4,4'-methylenebis[2-[N-(4-chlorophenyl)amide]-3-hydroxynaphthalene], 4 parts of alkylnaphthalene sulfonate and 76 parts of desalted water were dispersed by means of a sand grinder mill to obtain a particulate charge control agent dispersion. The resulting dispersion had an average particle diameter determined by UPA of 200 nm.

Production of Toner for Development 1

| Production of toner for development 1 | |
|---|---|
| Primary polymer particle dispersion 1 | 104 parts (71 g as solid content) |
| Particulate resin dispersion 1 | 6 parts (as solid content) |
| Particulate colorant dispersion 1 | 6.7 parts (as solid content) |
| Particulate charge control agent dispersion 1 | 2 parts (as solid content) |
| 15% aqueous solution of NEOGEN SC | 0.5 part (as solid content) |

By using the above-described respective components, toner was produced according to the following manner.

To a reactor (volume 1 liter, an anchor blade equipped with a baffle) were charged primary polymer particle dispersion and aqueous solution of 15% NEOGEN SC, which were uniformly mixed. Then particulate colorant dispersion was added to the resulting mixture, which were also uniformly mixed. Aqueous aluminum sulfate (0.6 part as solid content) was dropwise added to the mixed dispersion thus obtained with stirring. Thereafter, with stirring, the mixed dispersion obtained was heated to 51° C., which took 20 minutes, and the mixed dispersion was kept at that temperature for 1 hour, further heated to 58° C. for 6 minutes, where it was kept for 1 hour. Thereafter, particulate charge control agent dispersion, particulate resin dispersion and aqueous aluminum sulfate (0.07 part as the solid content) were successively added, which were heated to 60° C. for 10 minutes. After keeping the resulting mixture for 30 minutes, 15% aqueous solution of NEOGEN SC (3 parts as solid content) was added thereto. The resulting mixture was heated to 95° C. for 35 minutes where the mixture was kept for 3.5 hours. Successively, the mixture obtained was cooled, filtered, washed with water, and then dried to obtain a toner (toner 1).

To 100 parts of the toner thus obtained was mixed 0.6 part of silica having been subjected to hydrophobic surface treatment with stirring to obtain a toner for development (toner for development 1).

Evaluation of Toner 1

The toner for development obtained had a volume-average particle diameter determined by COULTER COUNTER of 7.2 μm. In the resulting toner, the portion having a volume particle diameter of 5 μm or less was 3.5%. While the portion having a volume particle diameter of 15 μm or more was 0.5%. The ratio of the volume-average particle diameter and the number-average particle diameter was 1.12. 50% circular degree of the toner was 0.97.

The fixability of toner for development 1 was evaluated. As the result, at a fixing rate of 120 mm/s, the toner was fixed at a temperature of from 170° C. to 220° C., and at a fixing rate of 30 mm/s, the toner was fixed at a temperature of from 130° C. to 220° C. OHP transparency was 70%.

The charged amount of toner 1 was −7 μC/g and the charged amount of toner for development 1 was −15 μC/g. The blocking resistance was A.

Figure 7:
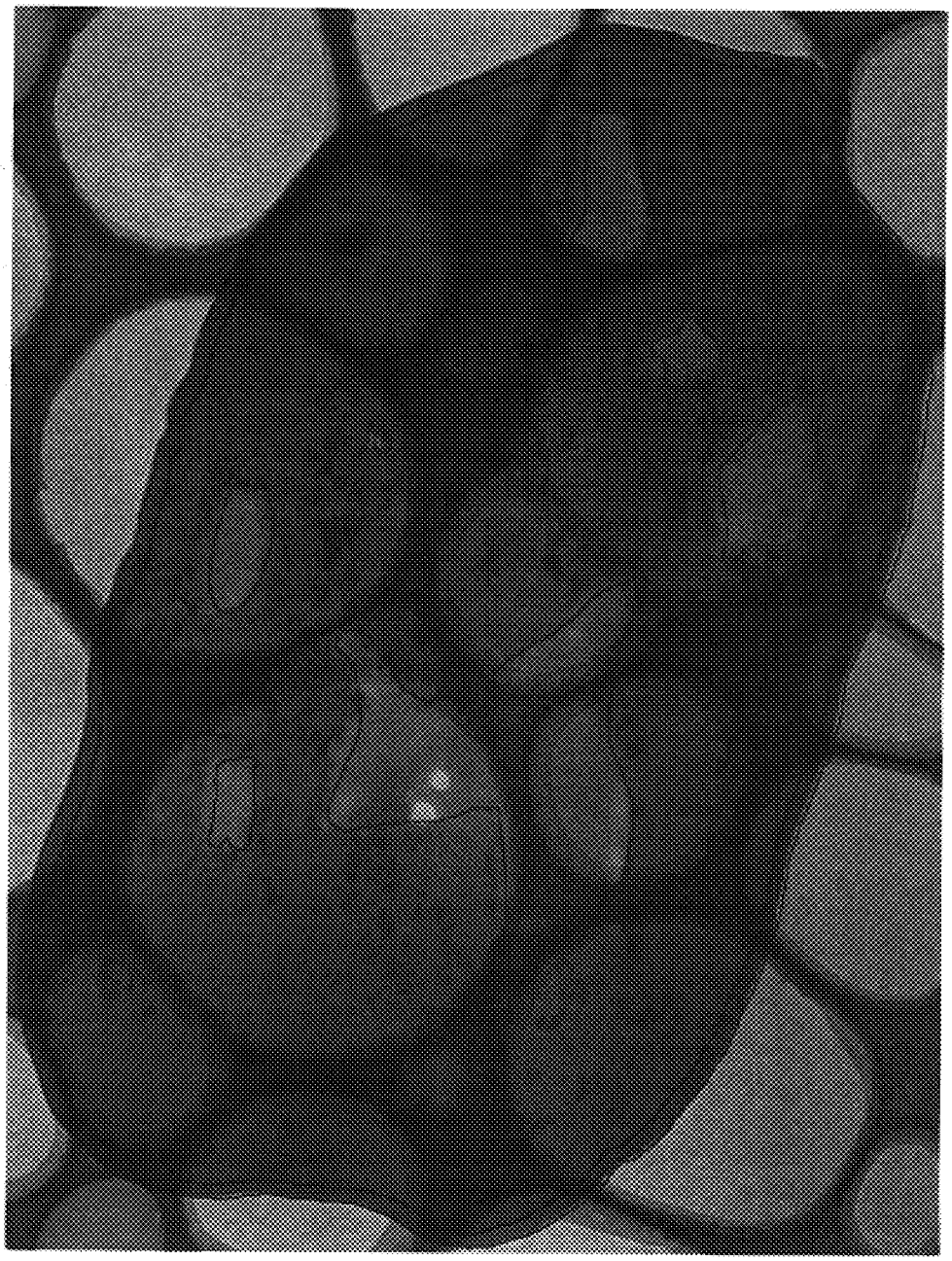
FIG. 7 is a TEM photograph of the cross section of the toner obtained in Reference Synthesis Example.

The toner was cut out to have a thickness of 80 nm and photographed by a transmission type electron microscope (TEM). In FIG. 7 is shown a TEM photograph of the cross section of the resulting toner. An analytical technician of electron microscope judged the portion corresponding to the particulate wax on the basis of light and shade of the resulting photograph (pale portion in the photograph) and determined the region thereof.

Figure 8:
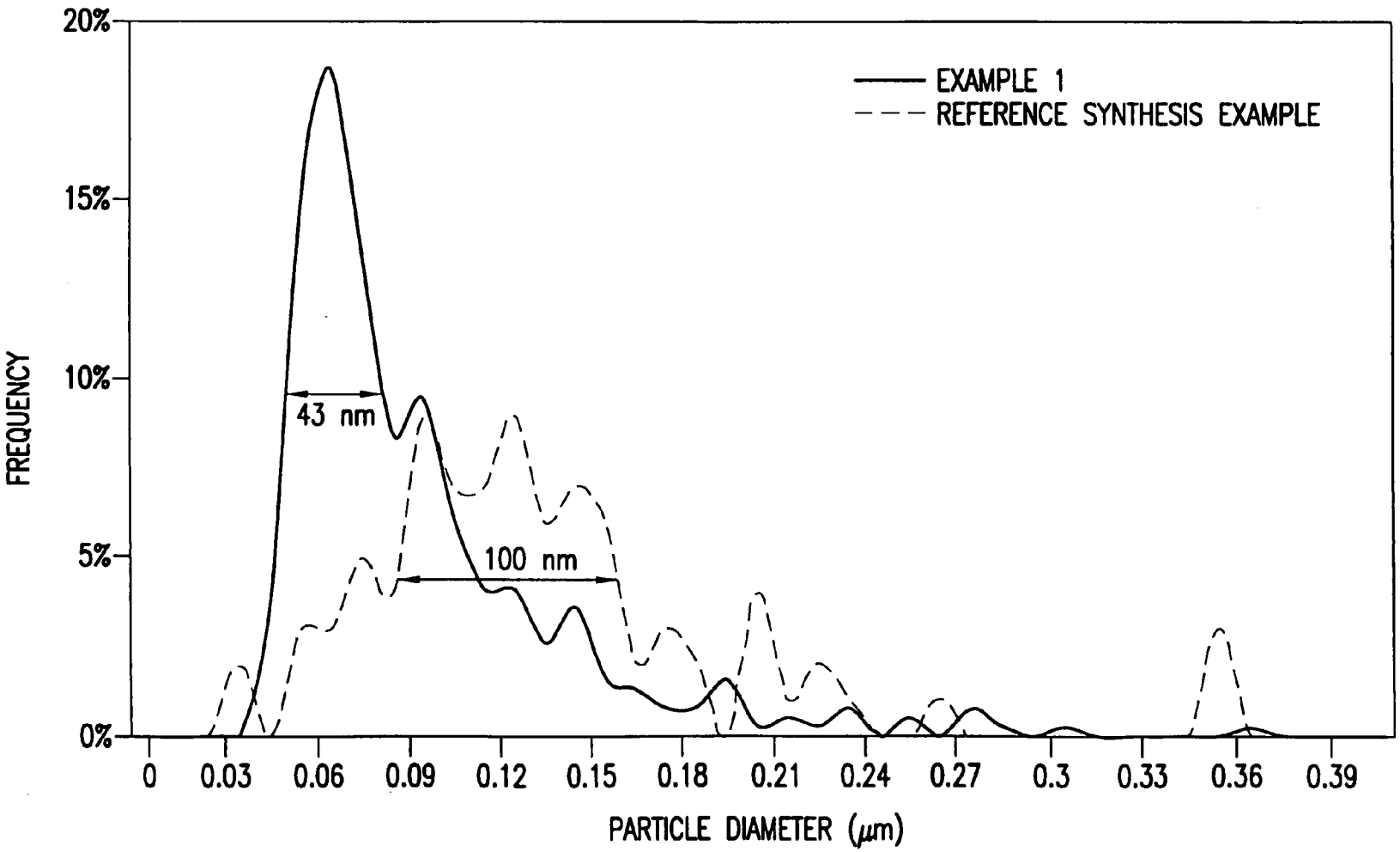
FIG. 8 represents a graph showing the distribution of the number-average particle diameter of particulate wax observed in the cross section of the toner (particle diameter of 0 to 1.5 μm)
Figure 9:
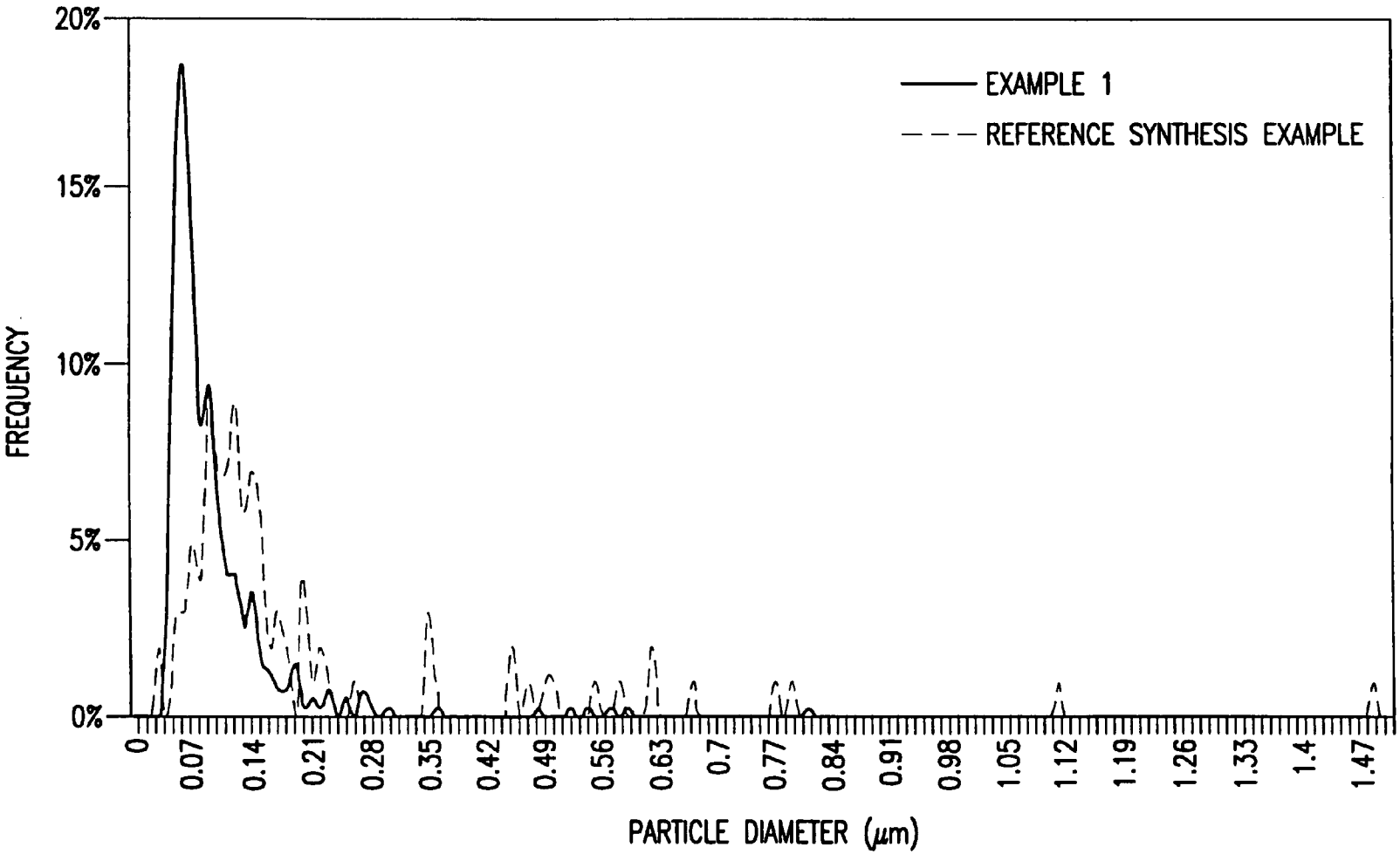
FIG. 9 represents a graph showing the distribution of the number-average particle diameter of particulate wax observed in the cross section of the toner (particle diameter of 0 to 0.5 μm); in which 1 denotes primary polymer particles having wax encapsulated therein, 2 denotes primary polymer particles substantially free of wax, 3 denotes particulate resin having wax encapsulated therein, 4 denotes particulate resin substantially free of wax, 5 denotes particles obtained by fusion-bonding primary polymer particles, 6 denotes particles obtained by fusion-bonding both primary polymer particles and particulate resin, and 7 denotes wax.

Regarding the region decided to be the part corresponding to the particulate wax, the number and the area of the particles of the particulate wax were calculated by an image processing apparatus, and regarding respective particles, the diameter of the same in the case where the particle was assumed to have a circular form was calculated on the basis of the calculated area (This is the particle diameter of the particulate wax observed in the cross section of the toner), and further the number-average particle diameter and the half value width were determined. In FIGS. 8 and 9, are shown graphs showing the distribution of the number-average particle diameter. The solid line represents the distribution of the toner obtained in Example 1.

The number-average particle diameter was 92 nm and the half value width of the same was 43 nm. While in the region of the depth of 0.1 μm from the toner surface, the existence ratio of the particulate wax having a particle diameter of 0.01 μm or more (area ratio) was 0%. The existence ratio of the particulate wax having a particle diameter of 0.01 μm or more (area ratio) in the other part was 4.5%.

Example 2

(Wax Dispersion 2)

Dispersion prepared as in wax dispersion 1 was used. An average particle diameter of the particulate ester wax obtained determined by LA-500 was 340 nm.

(Primary Polymer Particle Dispersion 2).

Into a reactor (volume 60 liter, inner diameter 400 mm) equipped with an agitator (three blades), a heating condenser, a concentrating apparatus and an apparatus for charging starting materials and auxiliaries were charged wax dispersion 1 28 parts, 15% aqueous solution of NEOGEN SC 1.2 parts and desalted water 393 parts, which were then heated to a temperature of 90° C. in a flow of nitrogen. Successively, 8% aqueous hydrogen peroxide 1.6 parts and 8% aqueous ascorbic acid 1.6 parts were added thereto.

Thereafter, to the mixture obtained a mixture of the following monomers and aqueous solution of emulsifier was added for 5 hours from the initiation of polymerization and aqueous polymerization initiator was added for 6 hours from the initiation of polymerization. The resulting reaction mixture was further kept for 30 minutes.

| | |
|---|---|
| [Monomers] | |
| Styrene | 79 parts |
| Butyl acrylate | 21 parts |
| Acrylic acid | 3 parts |
| Bromotrichloromethane | 0.45 part |
| 2-mercaptoethanol | 0.01 part |
| Hexanediol diacrylate | 0.9 part |
| [Aqueous solution of emulsifier] | |
| 15% aqueous solution of NEOGEN SC | 1 part |
| Desalted water | 25 parts |
| [Aqueous polymerization initiator] | |
| 8% aqueous hydrogen peroxide | 9 parts |
| 8% aqueous ascorbic acid | 9 parts |

After the completion of the polymerization reaction, the resulting product was cooled to obtain an opaque white polymer dispersion. The weight-average molecular weight of the soluble matter in THF of the polymer was 148,000, the average particle diameter determined by UPA was 207 nm and Tg was 55° C.

(Particulate Resin Dispersion 2)

The same particulate resin dispersion as particulate resin dispersion 1 was used.

(Particulate Colorant Dispersion 2)

A 20 part amount of pigment yellow 74, 7 parts of polyoxyethylenealkylphenyl ether and 73 parts of desalted water were dispersed by means of a sand grinder mill to obtain a particulate colorant dispersion. The resulting dispersion had an average particle diameter determined by UPA of 211 nm.

(Particulate Charge Control Agent Dispersion 2)

The same particulate charge control agent dispersion as particulate charge control agent dispersion 1 was used.

| Production of toner for development 2 | |
|---|---|
| Primary polymer particle dispersion 2 | 105 parts (as solid content) |
| Particulate resin dispersion 1 | 5 parts (as solid content) |
| Particulate colorant dispersion 2 | 6.7 parts (as solid content) |
| Particulate charge control agent dispersion 1 | 2 parts (as solid content) |

By using the above-described respective components, toner was produced according to the following manner.

To a reactor (volume 1 liter, an anchor blade equipped with a baffle) were charged primary polymer particle dispersion and particulate colorant dispersion, which were uniformly mixed. Aqueous aluminum sulfate (0.6 part as solid content) was dropwise added to the mixed dispersion thus obtained with stirring. Thereafter, with stirring, the mixed dispersion obtained was heated to 51° C., which took 25 minutes, and the mixed dispersion was kept at that temperature for 1 hour, further heated to 59° C. for 8 minutes, where it was kept for 40 minutes. Thereafter, particulate charge control agent dispersion, particulate resin dispersion and aqueous aluminum sulfate (0.07 part as the solid content) were successively added, which were heated to 61° C. for 15 minutes. After keeping the resulting mixture for 30 minutes, 15% aqueous solution of NEOGEN SC (3.8 parts as solid content) was added thereto. The resulting mixture was heated to 96° C. for 30 minutes where 10 the mixture was kept for 4 hours. Successively, the mixture obtained was cooled, filtered, washed with water, and then dried to obtain a toner (toner 2). To 100 parts of this toner thus obtained was mixed 0.6 part of silica having been subjected to hydrophobic surface treatment with stirring to obtain a toner for development (toner for development 2).

Evaluation of Toner 2

Toner for development 2 obtained had a volume-average particle diameter determined by COULTER COUNTER of 7.5 μm. In the resulting toner, the portion having a volume particle diameter of 5 μm or less was 1.6%. While the portion having a volume particle diameter of 15 μm or more was 0.7%. The ratio of the volume-average particle diameter and the number-average particle diameter was 1.14. 50% circular degree of the toner was 0.96.

The fixability of toner for development 2 was evaluated. As the result, at a fixing rate of 120 mm/s, the toner was fixed at a temperature of from 150° C. to 220° C., and at a fixing rate of 30 mm/s, the toner was fixed at a temperature of from 130° C. to 220° C.

The charged amount of toner 2 was −4 μC/g and the charged amount of toner for development 2 was −3 μC/g.

Example 3

(Wax Dispersion 3)

The same wax dispersion as wax dispersion 1 was used.

(Primary Polymer Particle Dispersion 3)

The same primary polymer particle dispersion as primary polymer particle dispersion 1 was used.

(Particulate Resin Dispersion 3)

The same particulate resin dispersion as particulate resin dispersion 1 was used.

(Particulate Colorant Dispersion 3)

A 20 part amount of pigment red 238 (compound of the following formula (A)), 2.5 parts of alkylbenzene sulfonate and 77.5 parts of desalted water were dispersed by means of a sand grinder mill to obtain a particulate colorant dispersion. The resulting dispersion had an average particle diameter determined by UPA of 181 nm.

(A)

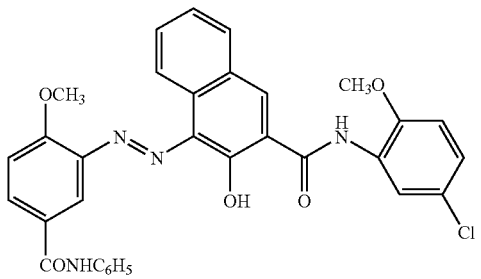

(Particulate Charge Control Agent Dispersion 3)

The same particulate charge control agent dispersion as particulate charge control agent dispersion 1 was used.

| Production of toner for development 3 | |
|---|---|
| Primary polymer particle dispersion 1 | 104 parts (as solid content) |
| Particulate resin dispersion 1 | 6 parts (as solid content) |
| Particulate colorant dispersion 3 | 6.7 parts (as solid content) |
| Particulate charge control agent dispersion 1 | 2 parts (as solid content) |
| 15% aqueous solution of NEOGEN SC | 0.65 part (as solid content) |

By using the above-described respective components, toner was produced according to the following manner.

To a reactor (volume 1 liter, an anchor blade equipped with a baffle) were charged primary polymer particle dispersion and 15% aqueous solution of NEOGEN SC, which were uniformly mixed. Further, particulate colorant dispersion was added thereto and the resulting mixed dispersion was uniformly mixed. Aqueous aluminum sulfate (0.8 part as solid content) was dropwise added to the mixed dispersion thus obtained with stirring. Thereafter, with stirring, the mixed dispersion obtained was heated to 51° C., which took 15 minutes, and the mixed dispersion was kept at that temperature for 1 hour, further heated to 59° C. for 6 minutes, where it was kept for 20 minutes. Thereafter, particulate charge control agent dispersion, particulate resin dispersion and aqueous aluminum sulfate (0.09 part as the solid content) were successively added, which were heated to 59° C. and kept at that temperature for 20 minutes. Then, 15% aqueous solution of NEOGEN SC (3.7 parts as solid content) was added thereto. The resulting mixture was heated to 95° C. for 25 minutes and further 15% aqueous solution of NEOGEN SC (0.7 part as solid content) was added, which were kept for 3.5 hours. Successively, the mixture obtained was cooled, filtered, washed with water, and then dried to obtain a toner (toner 3).

To 100 parts of toner 3 thus obtained was mixed 0.6 part of silica having been subjected to hydrophobic surface treatment with stirring to obtain a toner for development (toner for development 3).

Evaluation of Toner 3

The toner for development obtained had a volume-average particle diameter determined by COULTER COUNTER of 7.8 μm. In the resulting toner, the portion having a volume particle diameter of 5 μm or less was 2.1%. While the portion having a volume particle diameter of 15 μm or more was 2.1%. The ratio of the volume-average particle diameter and the number-average particle diameter was 1.15. 50% circular degree of the toner was 0.97.

The fixability of toner for development 3 was evaluated. As the result, at a fixing rate of 120 mm/s, the toner was fixed at a temperature of from 160° C. to 220° C., and at a fixing rate of 30 mm/s, the toner was fixed at a temperature of from 120° C. to 220° C.

The charged amount of toner 3 was −17 μC/g and the charged amount of toner for development 3 was −17 μC/g.

Example 4

(Wax Dispersion 4)

A 68.33 amount of desalted water, 30 parts of stearic acid ester of pentaerythritol (UNISTER H476, produced by NOF Corporation) and 1.67 parts of NEOGEN SC were mixed, then the resulting mixture was emulsified at 90° C. by applying high pressure shearing to obtain a particulate ester wax dispersion. An average particle diameter of the particulate ester wax obtained determined by LA-500 was 350 nm.

(Primary Polymer Particle Dispersion 4)

Into a reactor (volume 2 liter, inner diameter 120 mm) equipped with an agitator (full zone blade), a heating condenser, a concentrating apparatus and an apparatus for charging starting materials and auxiliaries were charged wax dispersion 4 35 parts and desalted water 397 parts, which were then heated to a temperature of 90° C. in a flow of nitrogen. Successively, 8% aqueous hydrogen peroxide 1.6 parts and 8% aqueous ascorbic acid 1.6 parts were added thereto.

Thereafter, to the mixture obtained a mixture of the following monomers and aqueous solution of emulsifier was added for 5 hours from the initiation of polymerization and aqueous polymerization initiator was added for 6 hours from the initiation of polymerization. The resulting reaction mixture was further kept for 30 minutes.

| | |
|---|---|
| [Monomers] | |
| Styrene (237 g) | 79 parts |
| Butyl acrylate | 21 parts |
| Acrylic acid | 3 parts |
| Octane thiol | 0.38 part |
| 2-mercaptoethanol | 0.01 part |
| Hexanediol diacrylate | 0.9 part |
| [Aqueous solution of emulsifier] | |
| 15% aqueous solution of NEOGEN SC | 1 part |
| Desalted water | 25 parts |
| [Aqueous polymerization initiator] | |
| 8% aqueous hydrogen peroxide | 9 parts |
| 8% aqueous ascorbic acid | 9 parts |

After the completion of the polymerization reaction, the resulting product was cooled to obtain an opaque white polymer dispersion. The weight-average molecular weight of the soluble matter in THF of the polymer was 139,000, the average particle diameter determined by UPA was 201 nm and Tg was not clear.

(Particulate Resin Dispersion 4)

Into a reactor (volume 2 liter, inner diameter 120 mm) equipped with an agitator (three backward blades), a heating condenser, a concentrating apparatus and an apparatus for charging starting materials and auxiliaries were charged 15% aqueous solution of NEOGEN SC 6 parts and desalted water 372 parts, which were then heated to a temperature of 90° C. in a flow of nitrogen. Successively, 8% aqueous hydrogen peroxide 1.6 parts and 8% aqueous ascorbic acid 1.6 parts were added thereto.

Thereafter, to the mixture obtained a mixture of the following monomers and aqueous solution of emulsifier was added for 5 hours from the initiation of polymerization and aqueous polymerization initiator was added for 6 hours from the initiation of polymerization. The resulting reaction mixture was further kept for 30 minutes.

| | |
|---|---|
| [Monomers] | |
| Styrene | 88 parts (308 g) |
| Butyl acrylate | 12 parts |

-continued

| | |
|---|---|
| Acrylic acid | 2 parts |
| Bromotrichloromethane | 0.5 part |
| 2-mercaptoethanol | 0.01 part |
| Hexanediol diacrylate | 0.4 part |
| [Aqueous solution of emulsifier] | |
| 15% aqueous solution of NEOGEN SC | 3 parts |
| Desalted water | 23 parts |
| [Aqueous polymerization initiator] | |
| 8% aqueous hydrogen peroxide | 9 parts |
| 8% aqueous ascorbic acid | 9 parts |

After the completion of the polymerization reaction, the resulting product was cooled to obtain an opaque white polymer dispersion. The weight-average molecular weight of the soluble matter in THF of the polymer was 57,000, the average particle diameter determined by UPA was 56 nm and Tg was 84° C.

(Particulate Colorant Dispersion 4)

The same particulate colorant dispersion as particulate colorant dispersion 1 was used.

(Particulate Charge Control Agent Dispersion 4)

The same particulate charge control agent dispersion as particulate charge control agent dispersion 1 was used.

| Production of toner for development 4 | |
|---|---|
| Primary polymer particle dispersion 4 | 105 parts (71 g as solid content) |
| Particulate resin dispersion 4 | 5 parts (as solid content) |
| Particulate colorant dispersion 1 | 6.7 parts (as solid content) |
| Particulate charge control agent dispersion 1 | 2 parts (as solid content) |
| Aqueous solution of 15% NEOGEN SC | 0.5 parts (as solid content) |

By using the above-described respective components, toner was produced according to the following manner.

To a reactor (volume 1 liter, an anchor blade equipped with a baffle) were charged primary polymer particle dispersion and aqueous solution of 15% NEOGEN SC, which were uniformly mixed. Then particulate colorant dispersion was added to the resulting mixture, then the resulting mixture was uniformly mixed. Aqueous aluminum sulfate (0.53 part as solid content) was dropwise added to the mixed dispersion thus obtained with stirring. Thereafter, with stirring, the mixed dispersion obtained was heated to 50° C. for 25 minutes, and kept at that temperature for 1 hour, further heated to 63° C. for 35 minutes and kept for 20 minutes. Thereafter, particulate charge control agent dispersion, particulate resin dispersion and aqueous aluminum sulfate (0.07 part as solid content) were successively added, which were heated to 65° C. for 10 minutes. After keeping the resulting mixture for 30 minutes, 15% aqueous solution of NEOGEN SC (3 parts as solid content) was added thereto. The resulting mixture was heated to 96° C. for 30 minutes and kept for 5 hours. Successively, the mixture obtained was cooled, filtered, washed with water, and then dried to obtain a toner (toner 4).

To 100 parts of the toner thus obtained was mixed 0.6 parts of silica having been subjected to hydrophobic surface treatment with stirring to obtain a toner for development (toner for development 4).

Evaluation of Toner 4

Toner for development 4 obtained had a volume-average particle diameter determined by COULTER COUNTER of 7.9 μm. In the resulting toner, the portion having a volume particle diameter of 5 μm or less was 2%. While the portion having a volume particle diameter of 15 μm or more was 1.5%. The ratio of the volume-average particle diameter and the number-average particle diameter was 1.20. 50% circular degree of the toner was 0.95.

The fixability of toner for development 4 was evaluated. As the result, at a fixing rate of 120 nm/s, the toner was fixed at a temperature of from 170° C. to 220° C., and at a fixing rate of 30 mm/s, the toner was fixed at a temperature of from 130° C. to 220° C. OHP transparency was 70%.

The charged amount of toner 4 was −9 μC/g and the charged amount of toner for development 4 was −15 μC/g. The blocking resistance was A.

Example 5

(Wax Dispersion 5)

A 68.33 amount of desalted water, 30 parts of 7:3 mixture of an ester mixture mainly comprising behenyl behenate (UNISTER M2222SL, produced by NOF Corporation) and polyester wax (Mw=about 1000) and 1.67 parts of NEOGEN SC were mixed, then the resulting mixture was emulsified at 90° C. by applying high pressure shearing to obtain a dispersion of particulate ester wax. An average particle diameter of the particulate ester wax obtained determined by LA-500 was 490 nm.

(Primary Polymer Particle Dispersion 5)

Into a reactor (volume 2 liter, inner diameter 120 mm) equipped with an agitator (full zone blade), a heating condenser, a concentrating apparatus and an apparatus for charging starting materials and auxiliaries were charged wax dispersion 5 28 parts, 15% aqueous solution of NEOGEN SC 1.2 parts and desalted water 393 parts, which were then heated to a temperature of 90° C. in a flow of nitrogen. Successively, 8% aqueous hydrogen peroxide 1.6 parts and 8% aqueous ascorbic acid 1.6 parts were added thereto.

Thereafter, to the mixture obtained a mixture of the following monomers and aqueous solution of emulsifier was added for 5 hours from the initiation of polymerization and aqueous polymerization initiator was added for 6 hours from the initiation of polymerization. The resulting reaction mixture was further kept for 30 minutes.

| | |
|---|---|
| [Monomers] | |
| Styrene | 79 parts |
| Butyl acrylate | 21 parts |
| Acrylic acid | 3 parts |
| Bromotrichloromethane | 0.5 part |
| 2-mercaptoethanol | 0.01 part |
| Hexanediol diacrylate | 0.9 part |
| [Aqueous solution of emulsifier] | |
| 15% aqueous solution of NEOGEN SC | 1 part |
| Desalted water | 25 parts |
| [Aqueous polymerization initiator] | |
| 8% aqueous hydrogen peroxide | 9 parts |
| 8% aqueous ascorbic acid | 9 parts |

After the completion of the polymerization reaction, the resulting product was cooled to obtain an opaque white polymer dispersion. The weight-average molecular weight of the soluble matter in THF of the polymer was 117,000, the average particle diameter determined by UPA was 201 nm and Tg was 53° C.

(Particulate Resin Dispersion 5)

The same particulate resin dispersion as particulate resin dispersion 4 was used.

(Particulate Colorant Dispersion 5)

The same particulate colorant dispersion as particulate colorant dispersion 1 was used.

(Particulate Charge Control Agent Dispersion 5)

The same particulate charge control agent dispersion as particulate charge control agent dispersion 1 was used.

| Production of toner for development 5 | |
|---|---|
| Primary polymer particle dispersion 5 | 104 parts (as solid content) |
| Particulate resin dispersion 4 | 6 parts (as solid content) |
| Particulate colorant dispersion 1 | 6.7 parts (as solid content) |
| Particulate charge control agent dispersion 1 | 2 parts (as solid content) |
| Aqueous solution of 15% NEOGEN SC | 0.5 part (as solid content) |

By using the above-described respective components, toner was produced according to the following manner.

To a reactor (volume 1 liter, an anchor blade equipped with a baffle) were charged primary polymer particle dispersion and aqueous solution of 15% NEOGEN SC, which were uniformly mixed. Then particulate colorant dispersion was added to the resulting mixture, and uniformly mixed. Aqueous aluminum sulfate (0.52 part as solid content) was dropwise added to the mixed dispersion thus obtained with stirring. Thereafter, with stirring, the mixed dispersion obtained was heated to 50° C. for 20 minutes, and kept at that temperature for 1 hour, further heated to 66° C. for 40 minutes, and kept for 10 minutes. Thereafter, particulate charge control agent dispersion, particulate resin dispersion and aqueous aluminum sulfate (0.08 part as solid content) were successively added, which were heated to 68° C. for 10 minutes. After keeping the resulting mixture for 30 minutes, 15% aqueous solution of NEOGEN SC (3 parts as solid content) was added thereto. The resulting mixture was heated to 96° C. for 20 minutes and kept for 4.5 hours. Successively, the mixture obtained was cooled, filtered, washed with water, and then dried to obtain a toner (toner 5).

To 100 parts of the toner thus obtained was mixed 0.6 parts of silica having been subjected to hydrophobic surface treatment with stirring to obtain a toner for development (toner for development 5).

Evaluation of Toner 5

The toner for development obtained had a volume-average particle diameter determined by COULTER COUNTER of 8.2 μm. In the resulting toner, the portion having a volume particle diameter of 5 μm or less was 0.7%. While the portion having a volume particle diameter of 15 μm or more was 1.6%. The ratio of the volume-average particle diameter and the number-average particle diameter was 1.14. 50% circular degree of the toner was 0.95.

The fixability of toner for development 5 was evaluated. As the result, at a fixing rate of 120 mm/s, the toner was fixed at a temperature of from 170° C. to 220° C., and at a fixing rate of 30 mm/s, the toner was fixed at a temperature of from 120° C. to 200° C.

The charged amount of toner 5 was −3.5 μC/g and the charged amount of toner for development 5 was −21 μC/g.

Example 6

(Wax Dispersion 6)

A 68.33 amount of desalted water, 30 parts of an ester mixture mainly comprising behenyl behenate (UNISTER M2222SL, produced by NOF Corporation) and 1.67 parts of NEOGEN SC were mixed, then the resulting mixture was emulsified at 90° C. by applying high pressure shearing to obtain an ester wax dispersion. An average particle diameter of the ester wax obtained determined by LA-500 was 340 nm.

(Primary Polymer Particle Dispersion 6)

Into a reactor (volume 3 liter, inner diameter 150 mm) equipped with an agitator (three backward blades), a heating condenser, a concentrating apparatus and an apparatus for charging starting materials and auxiliaries were charged wax dispersion 6 35 parts and desalted water 396 parts, which were then heated to a temperature of 90° C. in a flow of nitrogen. Successively, 8% aqueous hydrogen peroxide 1.6 parts and 8% aqueous ascorbic acid 1.6 parts were added thereto.

Thereafter, to the mixture obtained a mixture of the following monomers and aqueous solution of emulsifier was added for 5 hours from the initiation of polymerization and aqueous polymerization initiator was added for 6 hours from the initiation of polymerization. The resulting reaction mixture was further kept for 30 minutes.

| | |
|---|---|
| [Monomers] | |
| Styrene | 79 parts |
| Butyl acrylate | 21 parts |
| Acrylic acid | 3 parts |
| Octane thiol | 0.38 part |
| 2-mercaptoethanol | 0.01 part |
| Hexanediol diacrylate | 0.7 part |
| [Aqueous solution of emulsifier] | |
| 15% aqueous solution of NEOGEN SC | 1 part |
| Desalted water | 25 parts |
| [Aqueous polymerization initiator] | |
| 8% aqueous hydrogen peroxide | 9 parts |
| 8% aqueous ascorbic acid | 9 parts |

After the completion of the polymerization reaction, the resulting product was cooled to obtain an opaque white polymer dispersion. The weight-average molecular weight of the soluble matter in THF of the polymer was 127,000, the average particle diameter determined by UPA was 201 nm and Tg was 55° C.

(Particulate Resin Dispersion 6)

Into a reactor (volume 2 liter, inner diameter 120 mm) equipped with an agitator (three backward blades), a heating condenser, a concentrating apparatus and an apparatus for charging starting materials and auxiliaries were charged 15% aqueous solution of NEOGEN SC 4.3 parts and desalted water 376 parts, which were then heated to a temperature of 90° C. in a flow of nitrogen. Successively, 8% aqueous hydrogen peroxide 1.6 parts and 8% aqueous ascorbic acid 1.6 parts were added thereto.

Thereafter, to the mixture obtained a mixture of the following monomers and aqueous solution of emulsifier was added for 5 hours from the initiation of polymerization and aqueous polymerization initiator was added for 6 hours from the initiation of polymerization. The resulting reaction mixture was further kept for 30 minutes.

| | |
|---|---|
| [Monomers] | |
| Styrene | 88 parts |
| Butyl acrylate | 12 parts |
| Acrylic acid | 3 parts |
| Bromotrichloromethane | 0.5 part |
| 2-mercaptoethanol | 0.01 part |
| Divinyl benzene | 0.4 part |
| [Aqueous solution of emulsifier] | |
| 15% aqueous solution of NEOGEN SC | 2.2 parts |
| Desalted water | 24 parts |
| [Aqueous polymerization initiator] | |
| 8% aqueous hydrogen peroxide | 9 parts |
| 8% aqueous ascorbic acid | 9 parts |

After the completion of the polymerization reaction, the resulting product was cooled to obtain an opaque white polymer dispersion. The weight-average molecular weight of the soluble matter in THF of the polymer was 111,000, the average particle diameter determined by UPA was 121 nm and Tg was 86° C.

(Particulate Colorant Dispersion 6)

A 20 part amount of pigment red 48:2 (compound represented by the following formula (B)), 4 parts of polyoxyethylene alkylphenyl ether and 76 parts of desalted water were dispersed by means of a sand grinder mill to obtain a particulate colorant dispersion. The resulting dispersion had an average particle diameter determined by UPA of 201 nm.

(B)

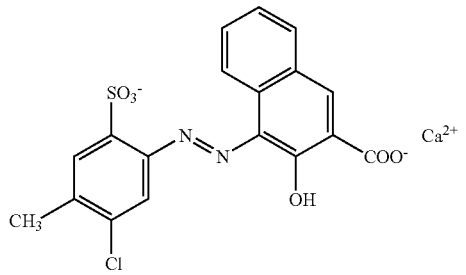

(Particulate Charge Control Agent Dispersion 6)

The same particulate charge control agent dispersion as particulate charge control agent dispersion 1 was used.

| Production of toner for development 6 | |
|---|---|
| Primary polymer particle dispersion 6 | 99 parts (as solid content) |
| Particulate resin dispersion 6 | 11 parts (as solid content) |
| Particulate colorant dispersion 6 | 6.7 parts (as solid content) |
| Particulate charge control agent dispersion 1 | 2 parts (as solid content) |
| Aqueous solution of 15% NEOGEN SC | 0.27 part (as solid content) |

By using the above-described respective components, toner was produced according to the following manner.

To a reactor (volume 1 liter, an anchor blade equipped with a baffle) were charged primary polymer particle dispersion and aqueous solution of 15% NEOGEN SC, which were uniformly mixed. Then particulate colorant dispersion was added to the resulting mixture, and uniformly mixed. Aqueous aluminum sulfate (0.52 part as solid content) was added to the mixed dispersion thus obtained with stirring. Thereafter, with stirring, the mixed dispersion obtained was heated to 55° C. for 30 minutes, and kept at that temperature for 1 hour, further heated to 61° C. for 20 minutes, and kept for 15 minutes. Thereafter, particulate charge control agent dispersion, particulate resin dispersion and aqueous aluminum sulfate (0.08 part as solid content) were successively added, which were heated to 63° C. for 10 minutes. After keeping the resulting mixture for 30 minutes, 15% aqueous solution of NEOGEN SC (3 parts as solid content) was added thereto. The resulting mixture was heated to 96° C. for 30 minutes and kept for 1 hour. Successively, the mixture obtained was cooled, filtered, washed with water, and then dried to obtain a toner (toner 6).

To 100 parts of the toner thus obtained was mixed 0.6 part of silica having been subjected to hydrophobic surface treatment with stirring to obtain a toner for development (toner for development 6).

Evaluation of Toner 6

Toner for development 6 obtained had a volume-average particle diameter determined by COULTER COUNTER of 7.8 μm. In the resulting toner, the portion having a volume particle diameter of 5 μm or less was 1.3%. While the portion having a volume particle diameter of 15 μm or more was 2.8%. The ratio of the volume-average particle diameter and the number-average particle diameter was 1.15. 50% circular degree of the toner was 0.98.

The fixability of toner for development 6 was evaluated. As the result, at a fixing rate of 120 mm/s, the toner was fixed at a temperature of from 160° C. to 210° C., and at a fixing rate of 30 nm/s, the toner was fixed at a temperature of from 120° C. to 190° C.

The charged amount of toner 6 was −15 μC/g and the charged amount of toner for development 6 was −28 μC/g.

Comparative Example 7 (Example wherein Coating with Particulate Resin is not Effected.)

(Wax Dispersion 7)

The same wax dispersion as wax dispersion 6 was used.

(Primary Polymer Particle Dispersion 7)

The same primary polymer particle dispersion as primary polymer particle dispersion 6 was used.

(Particulate Colorant Dispersion 7)

The same particulate colorant dispersion as particulate colorant dispersion 6 was used.

(Particulate Charge Control Agent Dispersion 7)

The same particulate charge control agent dispersion as particulate charge control agent dispersion 1 was used.

| Production of toner for development 7 | |
|---|---|
| Primary polymer particle dispersion 6 | 110 parts (as solid content) |
| Particulate colorant dispersion 6 | 6.7 parts (as solid content) |
| Particulate charge control agent dispersion 1 | 2 parts (as solid content) |
| Aqueous solution of 15% NEOGEN SC | 0.5 part (as solid content) |

To a reactor (volume 1 liter, an anchor blade equipped with a baffle) were charged primary polymer particle dispersion and aqueous solution of 15% NEOGEN SC, which were uniformly mixed. Then particulate colorant dispersion was added to the resulting mixture, and uniformly mixed. Aqueous aluminum sulfate (0.6 part as solid content) was added to the mixture dispersion thus obtained with stirring. Thereafter, with stirring, the mixed dispersion obtained was heated to 55° C. for 30 minutes, and kept at that temperature for 1 hour, further heated to 62° C. for 20 minutes, and kept for 10 minutes. Thereafter, particulate charge control agent dispersion was added and then kept at 62° C. for 30 minutes. Successively, 15% aqueous solution of NEOGEN SC (3 parts as solid content) was added thereto. The resulting mixture was heated to 96° C. for 35 minutes, and kept for 1.5 hours. Successively, the mixture obtained was cooled, filtered, washed with water, and then dried to obtain a toner (toner 7).

To 100 parts of the toner thus obtained was mixed 0.6 parts of silica having been subjected to hydrophobic surface treatment with stirring to obtain a toner for development (toner for development 7).

Evaluation of Toner 7

Toner for development 7 obtained had a volume-average particle diameter determined by COULTER COUNTER of 7.3 μm. In the resulting toner, the portion having a volume particle diameter of 5 μm or less was 3.1%. While the portion having a volume particle diameter of 15 μm or more was 0.5%. The ratio of the volume-average particle diameter and the number-average particle diameter was 1.14. 50% circular degree of the toner was 0.98.

The fixability of toner for development 7 was evaluated. As the result, at a fixing rate of 120 mm/s, the toner was fixed at a temperature of from 150° C. to 220° C., and at a fixing rate of 30 mm/s, the toner was fixed at a temperature of from 110° C. to 180° C.

The charged amount of toner 7 was −3 μC/g and the charged amount of toner for development 7 was −14 μC/g.

Example 8 2000-182606 Example 1

(Wax Dispersion 8)

The wax dispersion prepared according to the same manner as that of wax dispersion 6 was used. The average particle diameter of the same determined by LA-500 was 340 nm.

(Primary Polymer Particle Dispersion 8)

The primary polymer particle dispersion 8 was prepared using the same formulation and procedure as those of primary polymer particle dispersion 6.

After the completion of the polymerization reaction, the resulting product was cooled to obtain an opaque white polymer dispersion. The weight-average molecular weight of the soluble matter in THF of the polymer was 98,000, the average particle diameter determined by UPA was 188 nm and Tg was 57° C.

(Particulate Resin Dispersion 8)

The same particulate resin dispersion as particulate resin dispersion 6 was used.

(Particulate Colorant Dispersion 8)

The same particulate colorant dispersion as particulate colorant dispersion 1 was used.

(Particulate Charge Control Agent Dispersion 8)

The same particulate charge control agent dispersion as particulate charge control agent dispersion 1 was used.

| Production of toner for development 8 | |
|---|---|
| Primary polymer particle dispersion 8 | 99 parts (as solid content) |
| Particulate resin dispersion 6 | 11 parts (as solid content) |
| Particulate colorant dispersion 1 | 6.7 parts (as solid content) |
| Particulate charge control agent dispersion 1 | 2 parts (as solid content) |
| 15% aqueous solution of NEOGEN SC | 0.5 part (as solid content) |

By using the above-described respective components, toner was produced according to the following manner.

To a reactor (volume 1 liter, an anchor blade equipped with a baffle) were charged primary polymer particle dispersion and 15% aqueous solution of NEOGEN SC, which were uniformly mixed. Further, particulate colorant dispersion was added thereto and the resulting mixed dispersion was uniformly mixed. Aqueous aluminum sulfate (0.6 part as solid content) was dropwise added to the mixed dispersion thus obtained with stirring. Thereafter, with stirring, the mixed dispersion obtained was heated to 55° C. for 20 minutes, and kept at that temperature for 1 hour, further heated to 58° C. for 5 minutes, and kept for 1 hour. Thereafter, particulate charge control agent dispersion, particulate resin dispersion and aqueous aluminum sulfate (0.07 part as solid content) were successively added, which were heated to 65° C. for 25 minutes. Then, 15% aqueous solution of NEOGEN SC (4.1 parts as solid content) was added thereto. The resulting mixture was heated to 95° C. for 30 minutes, and kept for 2 hours. Successively, the mixture obtained was cooled, filtered, washed with water, and then dried to obtain a toner (toner 8).

To 100 parts of this toner thus obtained was mixed 0.6 part of silica having been subjected to hydrophobic surface treatment with stirring to obtain a toner for development (toner for development 8).

Evaluation of Toner 8

The toner for development 8 obtained had a volume-average particle diameter determined by COULTER COUNTER of 7.3 μm. In the resulting toner, the portion having a volume particle diameter of 5 μm or less was 1.4%. While the portion having a volume particle diameter of 15 μm or more was 0.3%. The ratio of the volume-average particle diameter and the number-average particle diameter was 1.11. 50% circular degree of the toner was 0.98.

The fixability of toner for development 8 was evaluated. As the result, at a fixing rate of 120 mm/s, the toner was fixed at a temperature of from 180° C. to 220° C., and at a fixing rate of 30 mm/s, the toner was fixed at a temperature of from 150° C. to 180° C.

The charged amount of toner 8 was −8 μC/g and the charged amount of toner for development 8 was −14 μC/g.

Example 9 2000-182606 Example 2

(Wax Dispersion 9)

The same wax dispersion as wax dispersion 8 was used.

(Primary Polymer Particle Dispersion 9)

The same primary polymer particle dispersion as primary polymer particle dispersion 8 was used.

(Particulate Resin Dispersion 9)

The same particulate resin dispersion as particulate resin dispersion 6 was used.

(Particulate Colorant Dispersion 9)

The same particulate colorant dispersion as particulate colorant dispersion 3 was used.

(Particulate Charge Control Agent Dispersion 9)

The same particulate charge control agent dispersion as particulate charge control agent dispersion 1 was used.

| Production of toner for development 9 | |
|---|---|
| Primary polymer particle dispersion 8 | 99 parts (as solid content) |
| Particulate resin dispersion 6 | 11 parts (as solid content) |
| Particulate colorant dispersion 3 | 6.7 parts (as solid content) |
| Particulate charge control agent dispersion 1 | 2 parts (as solid content) |
| 15% aqueous solution of NEOGEN SC | 0.65 part (as solid content) |

By using the above-described respective components, toner was produced according to the following manner.

To a reactor (volume 1 liter, an anchor blade equipped with a baffle) were charged primary polymer particle dispersion and 15% aqueous solution of NEOGEN SC, which were uniformly mixed. Further, particulate colorant dispersion was added thereto and uniformly mixed. Aqueous aluminum sulfate (0.8 part as solid content) was dropwise added to the mixed dispersion thus obtained with stirring. Thereafter, with stirring, the mixed dispersion obtained was heated to 55° C. for 25 minutes, and kept at that temperature for 1 hour. Thereafter, particulate charge control agent dispersion was added, and heated to 57° C. for 2 minutes. Then, particulate resin dispersion was added thereto, and kept at 57° C. for 35 minutes. Successively, 15% aqueous solution of NEOGEN SC (4 parts as solid content) was added thereto. The resulting mixture was heated to 95° C. for 40 minutes, and kept for 4 hours. Successively, the mixture obtained was cooled, filtered, washed with water, and then dried to obtain a toner (toner 9).

To 100 parts of this toner thus obtained was mixed 0.6 part of silica having been subjected to hydrophobic surface treatment with stirring to obtain a toner for development (toner for development 9).

Evaluation of Toner 9

Toner for development 9 obtained had a volume-average particle diameter determined by COULTER COUNTER of 7.6 μm. In the resulting toner, the portion having a volume particle diameter of 5 μor less was 1.6%. While the portion having a volume particle diameter of 15 μm or more was 2.4%. The ratio of the volume-average particle diameter and the number-average particle diameter was 1.15. 50% circular degree of the toner was 0.97.

The fixability of toner for development 9 was evaluated. As the result, at a fixing rate of 120 mm/s, the toner was fixed at a temperature of from 200° C. to 220° C., and at a fixing rate of 30 mm/s, the toner was fixed at a temperature of from 160° C. to 190° C.

The charged amount of toner 9 was −20 μC/g and the charged amount of toner for development 9 was −25 μC/g.

Comparative Example 10 (Example wherein Coating with Particulate Resin is not Effected.)

(Wax Dispersion 10)

Dispersion prepared as in wax dispersion 6 was used. An average particle diameter of the wax dispersion obtained determined by LA-500 was 340 nm.

(Primary Polymer Particle Dispersion 10).

Into a reactor (volume 60 liter, inner diameter 400 mm) equipped with an agitator (three blades), a heating condenser, a concentrating apparatus and an apparatus for charging starting materials and auxiliaries were charged wax dispersion 35 parts and desalted water 395 parts, then the resulting mixture was heated to a temperature of 90° C. in a flow of nitrogen. Successively, 8% aqueous hydrogen peroxide 1.6 parts and 8% aqueous ascorbic acid 1.6 parts were added thereto.

Thereafter, to the mixture obtained a mixture of the following monomers and aqueous solution of emulsifier was added for 5 hours from the initiation of polymerization and aqueous polymerization initiator was added for 6 hours from the initiation of polymerization. The resulting reaction mixture was further kept for 30 minutes.

| | |
|---|---|
| [Monomers] | |
| Styrene | 79 parts |
| Butyl acrylate | 21 parts |
| Acrylic acid | 3 parts |
| Bromotrichloromethane | 0.5 part |
| 2-mercaptoethanol | 0.01 part |
| Divinyl benzene | 0.4 part |
| [Aqueous solution of emulsifier] | |
| 15% aqueous solution of NEOGEN SC | 1 part |
| Desalted water | 25 parts |
| [Aqueous polymerization initiator] | |
| 8% aqueous hydrogen peroxide | 9 parts |
| 8% aqueous ascorbic acid | 9 parts |

After the completion of the polymerization reaction, the resulting product was cooled to obtain an opaque white polymer dispersion. The weight-average molecular weight of the soluble matter in THF of the polymer was 154,000, the average particle diameter determined by UPA was 195 nm and Tg was 57° C.

(Particulate Colorant Dispersion 10)

The same particulate colorant dispersion as particulate colorant dispersion 3 was used.

(Particulate Charge Control Agent Dispersion 10)

The same particulate charge control agent dispersion as particulate charge control agent dispersion 1 was used.

| Production of toner for development 10 | |
|---|---|
| Primary polymer particle dispersion 10 | 110 parts (as solid content) |
| Particulate colorant dispersion 3 | 6.7 parts (as solid content) |
| Particulate charge control agent dispersion 1 | 2 parts (as solid content) |
| 15% aqueous solution of NEOGEN SC | 0.65 part (as solid content) |

By using the above-described respective components, toner was produced according to the following manner.

To a reactor (volume 1 liter, an anchor blade equipped with a baffle) were charged primary polymer particle dispersion and 15% aqueous solution of NEOGEN SC, which were uniformly mixed. Then, particulate colorant dispersion was added thereto and uniformly mixed. Aqueous aluminum sulfate (0.9 part as solid content) was dropwise added to the mixed dispersion thus obtained with stirring, then particulate charge control agent dispersion was also added. Thereafter, with stirring, the mixed dispersion obtained was heated to 60° C. for 20 minutes, and kept at that temperature for 30 minutes, further heated to 61° C. for 2 minutes and kept for 1 hour. Then, 15% aqueous solution of NEOGEN SC (5 parts as solid content) was successively added, and heated to 95° C. for 25 minutes. After keeping the resulting mixture for 5 hours, the mixture was cooled, filtered, washed with water, and then dried to obtain a toner (toner 10).

To 100 parts of the toner thus obtained was mixed 0.6 part of silica having been subjected to hydrophobic surface treatment with stirring to obtain a toner for development (toner for development 10).

Evaluation of Toner 10

Toner for development 10 obtained had a volume-average particle diameter determined by COULTER COUNTER of 7.5 μm. In the resulting toner, the portion having a volume particle diameter of 5 μm or less was 4.1%. While the portion having a volume particle diameter of 15 μm or more was 2.3%. The ratio of the volume-average particle diameter and the number-average particle diameter was 1.19. 50% circular degree of the toner was 0.98.

The fixability of toner for development 10 was evaluated. As the result, at a fixing rate of 120 mm/s, the toner was fixed at a temperature of from 158° C. to 200° C., and at a fixing rate of 30 mm/s, the toner was fixed at a temperature of from 123° C. to 182° C.

The charged amount of toner 10 was +15 μC/g and the charged amount of toner for development 10 was +11 μC/g.

Comparative Example 11 (Example wherein both Primary Polymer Particle and Particulate Resin do not Comprise Wax)

(Primary Polymer Particle Dispersion 11)

Into a reactor (volume 60 liter, inner diameter 400 mm) equipped with an agitator (three blades), a heating condenser, a concentrating apparatus and an apparatus for charging starting materials and auxiliaries were charged 2 parts of 15% aqueous solution of NEOGEN SC and 378 parts of desalted water, which were then heated to a temperature of 90° C. in a flow of nitrogen. Successively, 8% aqueous hydrogen peroxide 1.6 parts and 8% aqueous ascorbic acid 1.6 parts were added thereto.

Thereafter, to the mixture obtained a mixture of the following monomers and aqueous solution of emulsifier was added for 5 hours from the initiation of polymerization and aqueous polymerization initiator was added for 6 hours from the initiation of polymerization. The resulting reaction mixture was further kept for 30 minutes.

| | |
|---|---|
| [Monomers] | |
| Styrene | 79 parts |
| Butyl acrylate | 21 parts |
| Acrylic acid | 3 parts |
| Bromotrichloromethane | 0.45 part |
| 2-mercaptoethanol | 0.01 part |
| Hexanediol diacrylate | 0.9 part |
| [Aqueous solution of emulsifier] | |
| 15% aqueous solution of NEOGEN SC | 1 part |
| Desalted water | 25 parts |
| [Aqueous polymerization initiator] | |
| 8% aqueous hydrogen peroxide | 9 parts |
| 8% aqueous ascorbic acid | 9 parts |

After the completion of the polymerization reaction, the resulting product was cooled to obtain an opaque white polymer dispersion. The weight-average molecular weight of the soluble matter in THF of the polymer was 126,000, the average particle diameter determined by UPA was 199 nm and Tg was 70° C.

(Particulate Resin Dispersion 11)

The same particulate resin dispersion as particulate resin dispersion 1 was used.

(Particulate Colorant Dispersion 11)

The same particulate colorant dispersion as particulate colorant dispersion 1 was used.

(Particulate Charge Control Agent Dispersion 11)

The same particulate charge control agent dispersion as particulate charge control agent dispersion 1 was used.

| Production of toner for development 11 | |
|---|---|
| Primary polymer particle dispersion 11 | 95 parts (as solid content) |
| Particulate resin dispersion 1 | 5 parts (as solid content) |
| Particulate colorant dispersion 1 | 6.7 parts (as solid content) |
| Particulate charge control agent dispersion 1 | 2 parts (as solid content) |
| Aqueous solution of 15% NEOGEN SC | 0.2 part (as solid content) |

By using the above-described respective components, toner was produced according to the following manner.

To a reactor (volume 1 liter, an anchor blade equipped with a baffle) were charged primary polymer particle dispersion and aqueous solution of 15% NEOGEN SC, which were uniformly mixed. Then particulate colorant dispersion was added to the resulting mixture, and uniformly mixed. Aqueous aluminum sulfate (0.54 part as solid content) was dropwise added to the mixture dispersion thus obtained with stirring. Thereafter, with stirring, the mixed dispersion obtained was heated to 50° C. for 25 minutes, and kept at that temperature for 1 hour, further heated to 69° C. for 1 hour, and also kept for 10 minutes. Thereafter, particulate charge control agent dispersion, particulate resin dispersion and aqueous aluminum sulfate (0.06 part as solid content) were successively added, which were heated to 71° C. for 10 minutes. After keeping the resulting mixture for 30 minutes, 15% aqueous solution of NEOGEN SC (3.3 parts as solid content) was added thereto. The resulting mixture was heated to 96° C. for 25 minutes and kept for 7 hours. Successively, the mixture obtained was cooled, filtered, washed with water, and then dried to obtain a toner (toner 11).

To 100 parts of the toner thus obtained was mixed 0.6 part of silica having been subjected to hydrophobic surface treatment with stirring to obtain a toner for development (toner for development 11).

Evaluation of Toner 11

Toner for development 11 obtained had a volume-average particle diameter determined by COULTER COUNTER of 7.5 μm. In the resulting toner, the portion having a volume particle diameter of 5 μm or less was 2.5%. While the portion having a volume particle diameter of 15 μm or more was 1.1%. The ratio of the volume-average particle diameter and the number-average particle diameter was 1.14. 50% circular degree of the toner was 0.93.

The fixability of toner for development 11 was evaluated. As the result, at a fixing rate of 120 mm/s, the toner was fixed at a temperature of from 180° C. to 190° C., and at a fixing rate of 30 mm/s, the toner was fixed at a temperature of from 140° C. to 160° C.

The charged amount of toner 11 was −27 μC/g and the charged amount of toner for development 11 was −11 μC/g.

Comparative Example 12 (Example wherein Particulate Resin Comprising Wax Encapsulated therein is Coated over the Outermost Layer)

(Primary Polymer Dispersion 12)

Into a reactor (volume 60 liter, inner diameter 400 mm) equipped with an agitator (three blades), a heating condenser, a concentrating apparatus and an apparatus for charging starting materials and auxiliaries were charged 2 parts of 15% aqueous solution of NEOGEN SC and 378 parts of desalted water, which were then heated to a temperature of 90° C. in a flow of nitrogen. Successively, 8% aqueous hydrogen peroxide 1.6 parts and 8% aqueous ascorbic acid 1.6 parts were added thereto.

Thereafter, to the mixture obtained a mixture of the following monomers and aqueous solution of emulsifier was added for 5 hours from the initiation of polymerization and aqueous polymerization initiator was added for 6 hours from the initiation of polymerization. The resulting reaction mixture was further kept for 30 minutes.

| | |
|---|---|
| [Monomers] | |
| Styrene | 79 parts |
| Butyl acrylate | 21 parts |
| Acrylic acid | 3 parts |
| Bromotrichloromethane | 0.45 part |
| 2-mercaptoethanol | 0.01 part |
| Hexanediol diacrylate | 0.9 part |
| [Aqueous solution of emulsifier] | |
| 15% aqueous solution of NEOGEN SC | 1 part |
| Desalted water | 25 parts |
| [Aqueous polymerization initiator] | |
| 8% aqueous hydrogen peroxide | 9 parts |
| 8% aqueous ascorbic acid | 9 parts |

After the completion of the polymerization reaction, the resulting product was cooled to obtain an opaque white polymer dispersion. The weight-average molecular weight of the soluble matter in THF of the polymer was 126,000, the average particle diameter determined by UPA was 199 nm and Tg was 70° C.

(Wax Dispersion 12)

The same wax dispersion as wax dispersion 1 was used ad the seed of particulate resin 12.

(Particulate Resin Dispersion 12)

Into a reactor (volume 60 liter, inner diameter 400 mm) equipped with an agitator (three blades), a heating condenser, a concentrating apparatus and an apparatus for charging starting materials and auxiliaries were charged 28 parts of wax dispersion 1, 1.2 parts of 15% aqueous solution of NEOGEN SC and 393 parts of desalted water, which were then heated to a temperature of 90° C. in a flow of nitrogen. Successively, 8% aqueous hydrogen peroxide 1.6 parts and 8% aqueous ascorbic acid 1.6 parts were added thereto.

Thereafter, to the mixture obtained a mixture of the following monomers and aqueous solution of emulsifier was added for 5 hours from the initiation of polymerization and aqueous polymerization initiator was added for 6 hours from the initiation of polymerization. The resulting reaction mixture was further kept for 30 minutes.

| | |
|---|---|
| [Monomers] | |
| Styrene | 79 parts |
| Butyl acrylate | 21 parts |
| Acrylic acid | 3 parts |
| Octane tiol | 0.38 part |
| 2-mercaptoethanol | 0.01 part |
| Hexanediol diacrylate | 0.9 part |
| [Aqueous solution of emulsifier] | |
| 15% aqueous solution of NEOGEN SC | 1 part |
| Desalted water | 25 parts |
| [Aqueous polymerization initiator] | |
| 8% aqueous hydrogen peroxide | 9 parts |
| 8% aqueous ascorbic acid | 9 parts |

After the completion of the polymerization reaction, the resulting product was cooled to obtain an opaque white polymer dispersion. The weight-average molecular weight of the soluble matter in THF of the polymer was 119,000, the average particle diameter determined by UPA was 189 nm and Tg was 57° C.

(Particulate Colorant Dispersion 12)

The same particulate colorant dispersion as particulate colorant dispersion 1 was used.

(Particulate Charge Control Agent Dispersion 12)

The same particulate charge control agent dispersion as particulate colorant dispersion 1 was used.

| Production of toner for development 12 | |
|---|---|
| Primary polymer particle dispersion 12 | 77 parts (as solid content) |
| Particulate resin dispersion 12 | 33 parts (as solid content) |
| Particulate colorant dispersion 1 | 6.7 parts (as solid content) |
| Particulate charge control agent dispersion 1 | 2 parts (as solid content) |

By using the above-described respective components, toner was produced according to the following manner.

To a reactor (volume 1 liter, an anchor blade equipped with a baffle) were charged primary polymer particle dispersion and particulate colorant dispersion, which were uniformly mixed. Aqueous aluminum sulfate (0.49 part as solid content) was dropwise added to the mixture dispersion thus obtained with stirring. Thereafter, with stirring, the mixed dispersion obtained was heated to 50° C. for 25 minutes, and kept at that temperature for 1 hour, further heated to 67° C. for 40 minutes, and also kept for 20 minutes. Thereafter, particulate charge control agent dispersion was added thereto and cooled to 60° C., successively particulate resin dispersion and aqueous aluminum sulfate (0.11 part as solid content) were added, which were kept at 60° C. for 30 minutes. Then, 15% aqueous solution of NEOGEN SC (3.5 parts as solid content) was added thereto. The resulting mixture was heated to 96° C. for 45 minutes and kept for 4 hours. Successively, the mixture obtained was cooled, filtered, washed with water, and then dried to obtain a toner (toner 12).

To 100 parts of the toner thus obtained was mixed 0.6 part of silica having been subjected to hydrophobic surface treatment with stirring to obtain a toner for development (toner for development 12).

Evaluation of Toner 12

The toner for development obtained had a volume-average particle diameter determined by COULTER COUNTER of 8.1 μm. In the resulting toner, the portion having a volume particle diameter of 5 μm or less was 1.2%. While the portion having a volume particle diameter of 15 μm or more was 2.8%. The ratio of the volume-average particle diameter and the number-average particle diameter was 1.17. 50% circular degree of the toner was 0.93.

The fixability of toner for development 12 was evaluated. As the result, at a fixing rate of 120 mm/s, the toner was fixed at a temperature of from 170° C. to 220° C., and at a fixing rate of 30 mm/s, the toner was fixed at a temperature of from 130° C. to 190° C.

The charged amount of toner 12 was −6 μC/g and the charged amount of toner for development 12 was +4 μC/g.

Example 13 J4582 (11-356833) Example 4

(Primary Polymer Particle Dispersion 13)

Into a reactor (volume 2 liter, inner diameter 120 mm) equipped with an agitator (three backward blades), a heating condenser, a concentrating apparatus and an apparatus for charging starting materials and auxiliaries were charged 10% aqueous sodium dodecylbenzene sulfonate 5.3 parts and desalted water 311 parts, which were then heated to a temperature of 90° C. in a flow of nitrogen. Successively, 2% aqueous hydrogen peroxide 6.4 parts and 2% aqueous ascorbic acid 6.4 parts were added thereto.

Thereafter, to the mixture obtained a mixture of the following monomers and aqueous solution of emulsifier was added for 5 hours from the initiation of polymerization and aqueous polymerization initiator was added for 6 hours from the initiation of polymerization. The resulting reaction mixture was further kept for 30 minutes.

| | |
|---|---|
| [Monomers] | |
| Styrene | 59 parts |
| Butyl acrylate | 39 parts |
| Acrylic acid | 2 parts |
| Bromotrichloromethane | 0.5 part |
| 1% aqueous 2-mercaptoethanol | 3 parts |
| [Aqueous solution of emulsifier] | |
| 10% aqueous sodium dodecylbenzene sulfonate | 2.7 parts |
| 1% aqueous polyoxyethylenenonylphenyl ether | 1.1 parts |
| Desalted water | 22 parts |
| [Aqueous polymerization initiator] | |
| 2% aqueous hydrogen peroxide | 36 parts |
| 2% aqueous ascorbic acid | 36 parts |

After the completion of the polymerization reaction, the resulting product was cooled to obtain an opaque white polymer dispersion. The weight-average molecular weight of the soluble matter in THF of the polymer was 54,000, the average particle diameter determined by UPA was 154 nm and Tg was 40° C.

(Wax Dispersion 13)

A 69.74 part amount of desalted water, 30 parts of an ester mixture mainly comprising behenyl behenate (UNISTER M2222SL, produced by NOF Corporation), 0.23 parts of sodium dodecylbenzene sulfonate and 0.03 parts of polyoxyethylenenonylphenyl ether were mixed, then the resulting mixture was emulsified by applying high pressure shearing to obtain a particulate ester wax dispersion. An average particle diameter of the particulate ester wax obtained determined by LA-500 was 820 nm.

(Particulate Resin Dispersion 13A)

Into a reactor (volume 2 liter, inner diameter 120 mm) equipped with an agitator (three backward blades), a heating condenser, a concentrating apparatus and an apparatus for charging starting materials and auxiliaries were charged wax dispersion 13 35 parts and desalted water 328 parts, which were then heated to a temperature of 90° C. in a flow of nitrogen. Successively, 2% aqueous hydrogen peroxide 6.4 parts and 2% aqueous ascorbic acid 6.4 parts were added thereto.

Thereafter, to the mixture obtained a mixture of the following monomers and aqueous solution of emulsifier was added for 5 hours from the initiation of polymerization and aqueous polymerization initiator was added for 6 hours from the initiation of polymerization. The resulting reaction mixture was further kept for 30 minutes.

| | |
|---|---|
| [Monomers] | |
| Styrene | 72 parts |
| Butyl acrylate | 26 parts |
| Acrylic acid | 2 parts |
| Bromotrichloromethane | 0.5 part |
| 1% aqueous 2-mercaptoethanol | 3 parts |
| [Aqueous solution of emulsifier] | |
| 10% aqueous sodium dodecylbenzene sulfonate | 2.7 parts |
| 1% aqueous polyoxyethylenenonylphenyl ether | 1.1 parts |
| Desalted water | 22 parts |
| [Aqueous polymerization initiator] | |
| 2% aqueous hydrogen peroxide | 36 parts |
| 2% aqueous ascorbic acid | 36 parts |

After the completion of the polymerization reaction, the resulting product was cooled to obtain an opaque white polymer dispersion. The weight-average molecular weight of the soluble matter in THF of the polymer was 69,000, the average particle diameter determined by UPA was 244 nm and Tg was 60° C.

(Particulate Resin Dispersion 13B)

Emulsion of copolymer of diallyl phthalate and acrylate, having Tg of 90° C. and the particle diameter of 100 nm (Particulate Colorant Dispersion 13)

The same particulate colorant dispersion as particulate colorant dispersion 1 was used.

(Particulate Charge Control Agent Dispersion 13)

The same particulate charge control agent dispersion as particulate charge control agent dispersion 1 was used.

| Production of toner for development 13 | |
|---|---|
| Primary polymer particle dispersion 13 | 100 parts (as solid content) |
| Particulate resin dispersion 13A | 11 parts (as solid content) |
| Particulate resin dispersion 13B | 22 parts (as solid content) |
| Paraffin wax (LUVAX-1266, produced by Nippon Seirou K.K.) dispersion | 5 parts (as solid content) |
| Particulate colorant dispersion 1 | 6 parts (as solid content) |
| Particulate charge control agent dispersion 1 | 0.6 part (as solid content) |

By using the above-described respective components, toner was produced according to the following manner.

To a reactor (volume 1 liter, disper) were charged primary polymer particle dispersion, paraffin wax dispersion, particulate colorant dispersion and charge control agent dispersion, which were uniformly mixed. The resulting dispersion was adjusted to have a pH of 3.5 with stirring. Thereafter, the mixture was heated with stirring and was controlled to have a pH of 7 at a time when the particle diameter reached 5.5 μm. The mixture was further heated to 60° C. and kept for 1 hour, followed by cooling. The resulting product and particulate resin dispersion 13A were placed into a reactor (flat blade agitating blade) and adjusted to have a pH of 3.0 with stirring at room temperature. The stirring was further continued until the white turbid of the dispersion disappeared. Thereafter, the resulting product was heated to 40° C. and kept for 2 hours, followed by cooling. Then particulate resin dispersion 13B was added thereto and adjusted to have a pH of 2.0 with stirring at room temperature. The stirring was further continued until the white turbid of the dispersion disappeared. Thereafter, the resulting product was stepwise heated to 40° C. and kept for 2 hours, further stepwise heated to 60° C. and kept for 2 hours, followed by cooling. Successively, the mixture obtained was filtered, washed with water, and then dried to obtain a toner (toner 13).

To 100 parts of the toner thus obtained was mixed 0.6 part of silica having been subjected to hydrophobic surface treatment with stirring to obtain a toner for development (toner for development 13).

Evaluation of Toner 13

Toner for development 13 obtained was fixed at a temperature of from 120° C. to 165° C. at a fixing rate of 120 mm/S.

The charged amount of the toner was −9 μC/g and the charged amount of toner for development 14 was −15 μC/g.

Example 14

(Primary Polymer Particle Dispersion 14)

Into a reactor (volume 3 liter, inner diameter 150 mm) equipped with an agitator (two blades), a heating condenser, a concentrating apparatus and an apparatus for charging starting materials and auxiliaries were charged 10% aqueous sodium dodecylbenzene sulfonate 5.3 parts and desalted water 309 parts, which were then heated to a temperature of 90° C. in a flow of nitrogen. Successively, 2% aqueous hydrogen peroxide 6.4 parts and 2% aqueous ascorbic acid 6.4 parts were added thereto.

Thereafter, to the mixture obtained a mixture of the following monomers and aqueous solution of emulsifier was added for 5 hours from the initiation of polymerization and aqueous polymerization initiator was added for 6 hours from the initiation of polymerization. The resulting reaction mixture was further kept for 30 minutes.

| | |
|---|---|
| [Monomers] | |
| Styrene | 60 parts |
| Butyl acrylate | 40 parts |
| Acrylic acid | 3 parts |
| [Aqueous solution of emulsifier] | |
| 10% aqueous sodium dodecylbenzene sulfonate | 2.7 parts |
| 1% aqueous polyoxyethylenenonylphenyl ether | 1.1 parts |
| Desalted water | 22 parts |

-continued

| | |
|---|---|
| [Aqueous polymerization initiator] | |
| 2% aqueous hydrogen peroxide | 36 parts |
| 2% aqueous ascorbic acid | 36 parts |

After the completion of the polymerization reaction, the resulting product was cooled to obtain an opaque white polymer dispersion.

Successively, into a reactor (volume 3 liter, inner diameter 150 mm) equipped with an agitator (two blades), a heating condenser, a concentrating apparatus and an apparatus for charging starting materials and auxiliaries were charged the above-described wax dispersion 108 parts, 10% aqueous sodium dodecylbenzene sulfonate 5.3 parts and desalted water 311 parts, which were then heated to a temperature of 90° C. in a flow of nitrogen. Successively, 2% aqueous hydrogen peroxide 6.4 parts and 2% aqueous ascorbic acid 6.4 parts were added thereto.

Thereafter, to the mixture obtained the following monomers, aqueous solution of emulsifier and aqueous polymerization initiator were added and emulsion polymerization was effected for 6.5 hours.

| | |
|---|---|
| [Monomers] | |
| Styrene | 60 parts |
| Butyl acrylate | 40 parts |
| Acrylic acid | 3 parts |
| Bromotrichloromethane | 1.5 parts |
| 1% aqueous 2-mercaptoethanol | 3 parts |
| [Aqueous solution of emulsifier] | |
| 10% aqueous sodium dodecylbenzene sulfonate | 2.7 parts |
| 1% aqueous polyoxyethylenenonylphenyl ether | 1.1 parts |
| Desalted water | 22 parts |
| [Aqueous polymerization initiator] | |
| 2% aqueous hydrogen peroxide | 36 parts |
| 2% aqueous ascorbic acid | 36 parts |

After the completion of the polymerization reaction, the resulting product was cooled to obtain an opaque white polymer dispersion (primary polymer particle dispersion 15). The weight-average molecular weight of the soluble matter in THF of the polymer was 64,000, the average particle diameter determined by UPA was 268 nm and Tg was 39° C.

(Wax Dispersion 14)

The same wax dispersion as wax dispersion 13 was used.

(Particulate Resin Dispersion 14A)

Into a reactor (volume 2 liter, inner diameter 120 mm) equipped with an agitator (three backward blades), a heating condenser, a concentrating apparatus and an apparatus for charging starting materials and auxiliaries were charged wax dispersion 13 35 parts and desalted water 328 parts, which were then heated to a temperature of 90° C. in a flow of nitrogen. Successively, 2% aqueous hydrogen peroxide 6.4 parts and 2% aqueous ascorbic acid 6.4 parts were added thereto.

Thereafter, to the mixture obtained a mixture of the following monomers and aqueous solution of emulsifier was added for 5 hours from the initiation of polymerization and aqueous polymerization initiator was added for 6 hours from the initiation of polymerization. The resulting reaction mixture was further kept for 30 minutes.

| | |
|---|---|
| [Monomers] | |
| Styrene | 75 parts |
| Butyl acrylate | 25 parts |
| Acrylic acid | 3 parts |
| Bromotrichloromethane | 0.5 part |
| 1% aqueous 2-mercaptoethanol | 1 parts |
| [Aqueous solution of emulsifier] | |
| 10% aqueous sodium dodecylbenzene sulfonate | 2.7 parts |
| 1% aqueous polyoxyethylenenonylphenyl ether | 1.1 parts |
| Desalted water | 22 parts |
| [Aqueous polymerization initiator] | |
| 2% aqueous hydrogen peroxide | 36 parts |
| 2% aqueous ascorbic acid | 36 parts |

After the completion of the polymerization reaction, the resulting product was cooled to obtain an opaque white polymer dispersion. The weight-average molecular weight of the soluble matter in THF of the polymer was 58,000, the average particle diameter determined by UPA was 244 nm and Tg was not clear.

(Particulate Resin Dispersion 14B)

Into a reactor (volume 2 liter, inner diameter 150 mm) equipped with an agitator (three backward blades), a heating condenser, a concentrating apparatus and an apparatus for charging starting materials and auxiliaries were charged sodium aliphatic acid (NS soap, manufactured by Kao Corporation) 2 parts and desalted water 374 parts, which were then heated to a temperature of 75° C. in a flow of nitrogen. Successively, 1% aqueous potassium persulfate 20 parts were added thereto.

Thereafter, to the mixture obtained the following monomers were added for 3 hours and 20 minutes from the initiation of polymerization and in the course of this addition, aqueous solution of emulsifier and aqueous polymerization initiator were added and kept for 1 hour and 40 minutes.

| | |
|---|---|
| [Monomers] | |
| Styrene | 90 parts |
| Butyl acrylate | 10 parts |
| Bromotrichloromethane | 0.2 part |
| [Aqueous solution of emulsifier] | |
| 10% aqueous NS soap | 10 parts |
| [Aqueous polymerization initiator] | |
| 1% aqueous potassium persulfate | 10 parts |

After the completion of the polymerization reaction, the resulting product was cooled to obtain an opaque white polymer dispersion. The weight-average molecular weight of the soluble matter in THF of the polymer was 131,000, the average particle diameter determined by UPA was 25 nm and Tg was 84° C.

(Particulate Colorant Dispersion 14)

The same particulate colorant dispersion as particulate colorant dispersion 1 was used.

(Particulate Charge Control Agent Dispersion 14)

The same particulate charge control agent dispersion as particulate charge control agent dispersion 1 was used.

| Production of toner for development 14 | |
|---|---|
| Primary polymer particle dispersion 14 | 100 parts (as solid content) |
| Particulate resin dispersion 14A | 21.3 parts (as solid content) |
| Particulate resin dispersion 14B | 10.7 parts (as solid content) |
| Particulate colorant dispersion 1 | 6.7 parts (as solid content) |
| Particulate charge control agent dispersion 1 | 0.6 part (as solid content) |

By using the above-described respective components, toner was produced according to the following manner.

To a reactor were charged primary polymer particle dispersion and particulate colorant dispersion, which were uniformly mixed. Then, 10% aqueous sodium chloride (12 parts as solid content) was added thereto with stirring and kept for 30 minutes. Thereafter, the mixture obtained was heated with stirring and was controlled to have a pH of 6.5 at a time when the particle diameter reached 7 μm. The mixture was further heated to 95° C. and kept for 8 hours, followed by cooling. After filtering coarse powder, the resulting product was placed into a reactor (flat blade agitating blade) and was adjusted to have a pH of 2.0 with stirring at room temperature. Then particulate resin dispersion 14A was added thereto, successively heated to 40° C. and kept for 5 hours, further heated to 62° C. and kept for 3 hours, followed by cooling. Successively, particulate resin dispersion 14B was added thereto, heated to 40° C. and kept for 1 hour. Further, particulate charge control agent dispersion was added, kept at 40° C. for 2 hours, further heated to 64° C. and kept for 4 hours followed by cooling. The resulting product was filtered, washed with water, and then dried to obtain a toner (toner 14).

To 100 parts of the toner thus obtained was mixed 0.6 part of silica having been subjected to hydrophobic surface treatment with stirring to obtain a toner for development (toner for development 14).

Evaluation of Toner 14

Toner for development 14 obtained was fixed at a temperature of from 150° C. to 170° C. at a fixing rate of 120 mm/S.

The charged amount of toner 14 was −6 μC/g and the charged amount of toner for development 14 was −11 μC/g.

[Reference Synthesis Example] Copolymerized Product of Particulate Wax and Primary Polymer Particles (Wax Dispersion 15)

A 68.33 part amount of desalted water, 30 parts of 7:3 mixture of an ester mixture mainly comprising behenyl behenate (UNISTER M2222SL, produced by NOF Corporation) and an ester mixture mainly comprising stearyl stearate (UNISTER M9676, produced by NOF Corporation) and 1.67 parts of sodium dodecylbenzene sulfonate (NEOGEN SC, produced by Dai-ichi Kogyo Seiyaku Co., Ltd., 66% of active component) were mixed, then the resulting mixture was emulsified at 90° C. by applying high pressure shearing to obtain a dispersion of particulate ester wax. An average particle diameter of the particulate ester wax obtained determined by UPA was 290 nm.

(Primary Polymer Particle Dispersion 15)

Into a reactor (volume 3 liter, inner diameter 150 mm) equipped with an agitator (full zone blade), a heating condenser, a concentrating apparatus and an apparatus for charging starting materials and auxiliaries were charged 15% aqueous solution of NEOGEN SC 2 parts and desalted water 378 parts, which were then heated to a temperature of 90° C. in a flow of nitrogen. Successively, 8% aqueous hydrogen peroxide 1.6 parts and 8% aqueous ascorbic acid 1.6 parts were added thereto.

Thereafter, to the mixture obtained a mixture of the following monomers and aqueous solution of emulsifier was added for 5 hours from the initiation of polymerization and aqueous polymerization initiator was added for 6 hours from the initiation of polymerization. The resulting reaction mixture was further kept for 30 minutes.

| | |
|---|---|
| [Monomers] | |
| Styrene | 79 parts |
| Butyl acrylate | 21 parts |
| Acrylic acid | 3 parts |
| Bromotrichloromethane | 0.45 part |
| 2-mercaptoethanol | 0.01 part |
| Hexanediol diacrylate | 0.9 part |
| [Aqueous solution of emulsifier] | |
| 15% aqueous solution of NEOGEN SC | 1 part |
| Desalted water | 25 parts |
| [Aqueous polymerization initiator] | |
| 8% aqueous hydrogen peroxide | 9 parts |
| 8% aqueous ascorbic acid | 9 parts |

After the completion of the polymerization reaction, the resulting product was cooled to obtain an opaque white polymer dispersion. The weight-average molecular weight of the soluble matter in THF of the polymer was 158,000, the average particle diameter determined by UPA was 200 nm and Tg was 71° C.

(Particulate Resin Dispersion 15)

The same particulate resin dispersion as particulate resin dispersion 1 was used.

(Particulate Colorant Dispersion 15)

The same particulate colorant dispersion as particulate colorant dispersion 1 was used.

(Particulate Charge Control Agent Dispersion 15)

The same particulate charge control agent dispersion as particulate charge control agent dispersion 1 was used.

| Production of toner for development 1 | |
|---|---|
| Primary polymer particle dispersion 15 | 105 parts (as solid content) |
| Particulate resin dispersion 1 | 5 parts (as solid content) |
| Particulate colorant dispersion 1 | 6.7 parts (as solid content) |
| Particulate charge control agent dispersion 1 | 2 parts (as solid content) |
| Wax dispersion 15 | 8.8 parts (as solid content) |
| Aqueous solution of 15% NEOGEN SC | 0.5 part (as solid content) |

By using the above-described respective components, toner was produced according to the following manner.

To a reactor (volume 1 liter, an anchor blade equipped with a baffle) were charged primary polymer particle dispersion and aqueous solution of 15% NEOGEN SC, which were uniformly mixed. Then wax dispersion and particulate colorant dispersion were added to the resulting mixture, which were also uniformly mixed. Aqueous aluminum sulfate (0.6 part as solid content) was dropwise added to the mixed dispersion thus obtained with stirring. Thereafter, with stirring, the mixed dispersion obtained was heated to 55° C. for 15 minutes, and kept at that temperature for 1 hour. The mixed dispersion was further heated to 65° C. for 90 minutes, and kept for 5 minutes. Thereafter, particulate charge control agent dispersion, particulate resin dispersion and aqueous aluminum sulfate (0.07 part as solid content) were successively added, which were heated to 67° C. for 15 minutes. After keeping the resulting mixture for 60 minutes, 15% aqueous solution of NEOGEN SC (3 parts as solid content) was added thereto. The resulting mixture was heated to 95° C. for 20 minutes, and kept for 4 hours. Successively, the mixture obtained was cooled, filtered, washed with water, and then dried to obtain a toner.

The toner obtained had a volume-average particle diameter determined by COULTER COUNTER of 7.3 μm. In the resulting toner, the portion having a volume particle diameter of 5 μm or less was 3.0%. While the portion having a volume particle diameter of 15 μm or more was 1.2%. The ratio of the volume-average particle diameter and the number-average particle diameter was 1.14. 50% circular degree of the toner was 0.95.

The toner was cut out to have a thickness of 80 nm and the TEM photograph (FIG. 7) was photographed. As the result of the analysis as in the toner obtained in Example 1, the particulate wax observed in the cross section of the toner had a number-average particle diameter of 201 nm, a half value width of the number-average particle diameter was 100 nm. The distribution of the number-average particle diameter was shown in FIGS. 8 and 9 by dotted line.

The present application is based on Japanese patent applications JP 356833/1999 and 182606/2000, filed in the Japanese Patent Office on Dec. 16, 1999 and Jun. 19, 2000, respectively, the entire contents of which are hereby incorporated by reference.

| | | Wax | | Primary polymer particle | | | | Particulate resin | | | |
|---|---|---|---|---|---|---|---|---|---|---|---|
| | Pigment Kind | Kind and mp. ° C. | Particle size nm LA500 | Molecular weight Mw | Molecular weight peak Mp | Average particle diameter nm UPA | Tg ° C. | Molecular weight Mw | Molecular weight peak Mp | Average particle diameter nm UPA | Tg ° C. |
| Ex. 1 | Pigment blue 15:3 | Unister M2222Sl/ Unister M9676(70/30) 70° C./65° C. | 340 | 119,000 | 47,500 | 189 | 57 | 54,000 | 47,000 | 83 | 85 |
| Ex. 2 | Pigment yellow 74 | Unister M2222Sl/ Unister M9676(70/30) 70° C./65° C. | " | 148,000 | 55,500 | 207 | 55 | " | " | " | " |
| Ex. 3 | Pigment red 238 | Unister M2222Sl/ Unister M9676(70/30) 70° C./65° C. | " | 119,000 | 47,500 | 189 | 57 | " | " | " | " |
| Ex. 4 | Pigment blue 15:3 | Unister H476 65° C. | 350 | 139,000 | 56,000 | 201 | Not clear | 57,000 | 49,600 | 56 | 84 |
| Ex. 5 | Pigment blue 15:3 | Unister M2222SL/ Polyester wax (70/30) 70° C./65° C. | 490 | 117,000 | 53,000 | 201 | 53 | " | " | " | " |
| Ex. 6 | Pigment red 48:2 | Unister M2222SL 70° C. | 340 | 127,000 | 49,000 | 201 | 55 | 111,000 | 58.400 " | 121 " | 86 " |
| Comp. Ex. 7 | Pigment red 48:2 | Unister M2222SL 70° C. | " | " | " | " | " | — | — | — | — |
| Ex. 8 | Pigment blue 15:3 | Unister M2222SL 70° C. | " | 98,000 | 41,200 | 188 | 57 | 111,000 | 58,400 | 121 | 86 |
| Ex. 9 | Pigment red 238 | Unister M2222SL 70° C. | " | " | " | " | " | " | " | " | " |
| Comp. Ex. 10 | Pigment red 238 | Unister M2222SL 70° C. | " | 154,000 | 58,100 | 195 | 57 | — | — | — | — |
| Comp. Ex. 11 | Pigment blue 15:3 | None | — | 126,000 | 56,700 | 199 | 70 | 54,000 | 47,000 | 83 | 85 |
| Comp. Ex. 12 | Pigment blue 15:3 | Unister M2222SL/ Unister M9676(70/30) 70° C./65° C. | 340 | 126,000 | 56,700 | 199 | 70 | 119,000 | 47,500 | 189 | 57 |

-continued

| | | Wax | | Primary polymer particle | | | | Particulate resin | | | |
|---|---|---|---|---|---|---|---|---|---|---|---|
| | Pigment Kind | Kind and mp. ° C. | Particle size nm LA500 | Molecular weight Mw | Molecular weight peak Mp | Average particle diameter nm UPA | Tg ° C. | Molecular weight Mw | Molecular weight peak Mp | Average particle diameter nm UPA | Tg ° C. |
| Ex. 13 | Pigment blue 15:3 | Unister M2222SL 70° C. | 820 | 54,000 | 49,000 | 154 | 40 | A: 69000 B: undetermined | A: 60000 B: undetermined | A: 244 B: 100 | A: 60 B: 90 |
| Ex. 14 | Pigment blue 15:3 | Unister M2222SL 70° C. | " | 64,000 | 20,500 | 268 | 39 | A: 58000 B: 131000 | A: 52200 B: 111400 | A: 244 B: 25 | A: not clear B: 84 |

| | Toner | | | | | | | | | | |
|---|---|---|---|---|---|---|---|---|---|---|---|
| | Particle | | | Ratio of volume | | Charged amount μC/g | | Fixing temperature width | | | |
| | diameter (volume) μm | ≦5 μm (volume) % | ≧15 μm (volume) % | particle diamter/ number-average particle diameter | 50% circular degree | Non-external addition | External addition | 75 mm/sec (Nip 4 mm) ° C. | 19 mm/sec (Nip 4 mm) ° C. | OHP trans-parency | Blocking resist-ance |
| Example 1 | 7.2 | 3.5 | 0.5 | 1.12 | 0.97 | −7 | −15 | 170 to 220 | 130 to 220 | 70 | A |
| Example 2 | 7.5 | 1.6 | 0.7 | 1.14 | 0.96 | −4 | −3 | 150 to 220 | 130 to 220 | 65 | A |
| Example 3 | 7.8 | 2.1 | 2.1 | 1.15 | 0.97 | −17 | −17 | 160 to 220 | 120 to 220 | 70 | A |
| Example 4 | 7.9 | 2 | 1.5 | 1.2 | 0.95 | −9 | −15 | 170 to 220 | 130 to 220 | 70 | A |
| Example 5 | 8.2 | 0.7 | 1.6 | 1.14 | 0.95 | −3.5 | −21 | 170 to 220 | 120 to 200 | 65 | A |
| Example 6 | 7.8 | 1.3 | 2.8 | 1.15 | 0.98 | −15 | −28 | 160 to 210 | 120 to 190 | 65 | A |
| Comp. Ex. 7 | 7.3 | 3.1 | 0.5 | 1.14 | 0.98 | −3 | −14 | 150 to 220 | 110 to 180 | 65 | A |
| Example 8 | 7.3 | 1.4 | 0.3 | 1.11 | 0.98 | −8 | −14 | 180 to 220 | 150 to 180 | 60 | A |
| Example 9 | 7.6 | 1.6 | 2.4 | 1.15 | 0.97 | −20 | −25 | 200 to 220 | 160 to 190 | 60 | A |
| Comp. Ex. 10 | 7.5 | 4.1 | 2.3 | 1.19 | 0.98 | 15 | 11 | 158 to 200 | 123 to 182 | Undetermined | A |
| Comp. Ex. 11 | 7.5 | 2.5 | 1.1 | 1.14 | 0.93 | −27 | −11 | 180 to 190 | 140 to 160 | Offset | A |
| Comp. Ex. 12 | 8.1 | 1.2 | 2.8 | 1.17 | 0.93 | −6 | 4 | 170 to 220 | 130 to 190 | Undetermined | A |
| Example 13 | Undetermined | Undetermined | Undetermined | Undetermined | Undetermined | −9 | −15 | 120 to 165 | Undetermined | Undetermined | A |
| Example 14 | Undetermined | Undetermined | Undetermined | Undetermined | Undetermined | −6 | −11 | 150 to 170 | Undetermined | Undetermined | A |

What is claimed is:

1. A toner, comprising:

an agglomerate of particles comprising at least primary polymer particles and primary colorant particles, and at least one layer of a particulate resin coated on a substantial surface portion of said agglomerate of particles, wherein at least one of said primary polymer particles and said particulate resin further comprises a wax, wherein an outermost layer of said particulate resin is substantially free of wax, and wherein there are at least two layers of said particulate resin.

2. A toner, comprising:

an agglomerate of particles comprising at least primary polymer particles and primary colorant particles, and at least one layer of a particulate resin coated on a substantial surface portion of said agglomerate of particles, wherein at least one of said primary polymer particles and said particulate resin further comprises a wax, wherein an outermost layer of said particulate resin is substantially free of wax, and wherein the primary polymer particles do not comprise wax therein, and at least one non-outer layer of the particulate resin comprises said wax therein.

3. A toner, comprising:

an agglomerate of particles comprising at least primary polymer particles and primary colorant particles, and at least one layer of a particulate resin coated on a substantial surface portion of said agglomerate of particles, wherein at least one of said primary polymer particles and said particulate resin further comprises a wax, wherein an outermost layer of said particulate resin is substantially free of wax, and wherein two layers, an inner layer and an outer layer, of the particulate resin are coated on said agglomerate of particles.

4. The toner as claimed in claim 3, wherein the primary polymer particles do not comprise wax therein, the particulate resin in the inner layer comprises said wax therein, and the particulate resin in the outer layer is substantially free of wax.

5. A toner, comprising:

an agglomerate of particles comprising at least primary polymer particles and primary colorant particles, and at least one layer of a particulate resin coated on a substantial surface portion of said agglomerate of particles, wherein at least one of said primary polymer particles and said particulate resin further comprises a wax, wherein an outermost layer of said particulate resin is substantially free of wax, and wherein the particulate resin of a non-outer layer comprises from 1 to 40 parts by weight of wax therein based on 100 parts by weight of binder resin in the toner.

* * * * *

UNITED STATES PATENT AND TRADEMARK OFFICE

CERTIFICATE OF CORRECTION

PATENT NO. : 7,169,526 B2
APPLICATION NO. : 09/737579
DATED : January 30, 2007
INVENTOR(S) : Ishikawa et al.

It is certified that error appears in the above-identified patent and that said Letters Patent is hereby corrected as shown below:

On the title page, the Terminal Disclaimer information has been omitted. Item (45) and the Notice information should read as follows:

--(45) **Date of Patent: *Jan 30, 2007**

(* ) Notice: Subject to any disclaimer, the term of this patent is extended or adjusted under 35 U.S.C. 154(b) by 0 days.

This patent is subject to a terminal disclaimer.--

Signed and Sealed this

Twenty-ninth Day of May, 2007

JON W. DUDAS
*Director of the United States Patent and Trademark Office*